US007521621B2

(12) United States Patent
Okazaki et al.

(10) Patent No.: US 7,521,621 B2
(45) Date of Patent: Apr. 21, 2009

(54) COMPRESSED DATA STRUCTURE AND APPARATUS AND METHOD RELATED THERETO

(75) Inventors: Masatsugu Okazaki, Hamamatsu (JP); Tokio Shirakawa, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 11/860,484

(22) Filed: Sep. 24, 2007

(65) Prior Publication Data

US 2008/0078280 A1 Apr. 3, 2008

Related U.S. Application Data

(62) Division of application No. 10/676,205, filed on Sep. 30, 2003, now Pat. No. 7,378,586.

(30) Foreign Application Priority Data

Oct. 1, 2002 (JP) ..... 2002-288783
Mar. 25, 2003 (JP) ..... 2003-082922
Mar. 27, 2003 (JP) ..... 2003-087299

(51) Int. Cl.
*G10H 7/00* (2006.01)

(52) U.S. Cl. ..... 84/604; 704/500

(58) Field of Classification Search ..... 84/604, 84/602, 605–607; 704/500
See application file for complete search history.

(56) References Cited

U.S. PATENT DOCUMENTS 5,086,475 A 2/1992 Kutaragi et al.
5,438,535 A * 8/1995 Lattibeaudiere ..... 365/49.17
5,489,746 A * 2/1996 Suzuki et al. ..... 84/602
5,831,193 A * 11/1998 Suzuki et al. ..... 84/603
5,978,492 A 11/1999 Furuhashi
6,081,783 A * 6/2000 Divine et al. ..... 704/500
6,255,576 B1 7/2001 Suzuki et al.
6,300,552 B1 * 10/2001 Sato ..... 84/604
6,931,370 B1 * 8/2005 McDowell ..... 704/500

* cited by examiner

*Primary Examiner*—Jeffrey Donels
*Assistant Examiner*—Jianchun Qin
(74) *Attorney, Agent, or Firm*—Morrison & Foerster LLP

(57) ABSTRACT

Compressed waveform data structure is proposed which is suited for segmentation of a plurality of samples of compressed waveform data into a plurality of frames and subsequent storage of each of the frames. The number of bits per sample of the compressed waveform data is variable between the frames, but uniform, i.e. the same among all of the samples, within each of the frames. Each of the frames has a same data storage size. Each of the frames includes, in a predetermined layout, an auxiliary information area for storing auxiliary information that includes compression-related information to be used for decompressing the compressed waveform data, and a data area for storing a plurality of samples of the compressed waveform data of the frame with each of the samples comprising a same number of bits.

3 Claims, 15 Drawing Sheets

2 BITS

| | | | | | | | |
|---|---|---|---|---|---|---|---|
| 00 | PREDICTION COEFFICIENT | | | | | QUANTIZATION WIDTH | |
| 01 | NUMBER OF BITS | 1 | 2 | 3 | 4 | 5 | 6 |
| 02 | 7 | 8 | 9 | 10 | 11 | 12 | 13 |
| 03 | 15 | 16 | 17 | 18 | 19 | 20 | 21 |
| 04 | 23 | 24 | 25 | 26 | 27 | 28 | 29 |

3 BITS

| | | | | | | |
|---|---|---|---|---|---|---|
| 00 | PREDICTION COEFFICIENT | | | | QUANTIZATION WIDTH | |
| 01 | NUMBER OF BITS | 1 | 2 | 3 | 4 | |
| 02 | 5 | 6 | 7 | 8 | 9 | |
| 03 | 10 | 11 | 12 | 13 | 14 | 15 |
| 04 | | 16 | 17 | 18 | 19 | 20 |

4 BITS

| | | | | |
|---|---|---|---|---|
| 00 | PREDICTION COEFFICIENT | | QUANTIZATION WIDTH | |
| 01 | NUMBER OF BITS | 1 | 2 | 3 |
| 02 | 4 | 5 | 6 | 7 |
| 03 | 8 | 9 | 10 | 11 |
| 04 | 12 | 13 | 14 | 15 |

5 BITS

| | | | | |
|---|---|---|---|---|
| 00 | PREDICTION COEFFICIENT | | QUANTIZATION WIDTH | |
| 01 | NUMBER OF BITS | 1 | 2 | |
| 02 | 3 | 4 | 5 | 6 |
| 03 | | 7 | 8 | 9 |
| 04 | | 10 | 11 | 12 |

6 BITS

| | | | | |
|---|---|---|---|---|
| 00 | PREDICTION COEFFICIENT | | QUANTIZATION WIDTH | |
| 01 | NUMBER OF BITS | 1 | 2 | |
| 02 | 3 | 4 | 5 | |
| 03 | | 6 | 7 | |
| 04 | 8 | 9 | 10 | |

10 BITS

| | | | |
|---|---|---|---|
| 00 | PREDICTION COEFFICIENT | | QUANTIZATION WIDTH |
| 01 | NUMBER OF BITS | 1 | |
| 02 | 2 | 3 | |
| 03 | | 4 | |
| 04 | 5 | 6 | |

FIG. 8

| | | | | |
|---|---|---|---|---|
| 00 | NUMBER OF BITS | 1 | 2 | 3 |
| 01 | PREDICTION COEFFICIENT | 4 | 5 | 6 |
| 02 | | 7 | 8 | 9 |
| 03 | | 10 | 11 | 12 |
| 04 | | 13 | 14 | 15 |
| 05 | | 16 | 17 | 18 |
| 06 | QUANTIZATION WIDTH | 19 | 20 | 21 |
| 07 | | 22 | 23 | 24 |
| 08 | OTHERS | 25 | 26 | 27 |
| 09 | | 28 | 29 | 30 |

| | | | | |
|---|---|---|---|---|
| 00 | PREDICTION COEFFICIENT | 1 | 2 | 3 |
| 01 | | 4 | 5 | 6 |
| 02 | | 7 | 8 | 9 |
| 03 | | 10 | 11 | 12 |
| 04 | | 13 | 14 | 15 |
| 05 | NUMBER OF BITS | 16 | 17 | 18 |
| 06 | QUANTIZATION WIDTH | 19 | 20 | 21 |
| 07 | | 22 | 23 | 24 |
| 08 | OTHERS | 25 | 26 | 27 |
| 09 | | 28 | 29 | 30 |

(a)

| | AUXILIARY INFO. | DIFFERENCE CODE | | |
|---|---|---|---|---|
| 00 | NUMBER OF BITS | 1 | 2 | 3 |
| 01 | PREDICTION COEFFICIENT | 4 | 5 | 6 |
| 02 | | 7 | 8 | 9 |
| 03 | | 10 | 11 | 12 |
| 04 | | 13 | 14 | 15 |
| 05 | | 16 | 17 | 18 |
| 06 | QUANTIZATION WIDTH | 19 | 20 | 21 |
| 07 | | 22 | 23 | 24 |
| 08 | OTHERS | 25 | 26 | 27 |
| 09 | | 28 | 29 | 30 |

(b)

| | | | | | | |
|---|---|---|---|---|---|---|
| K_00-TH SUBFRAME | NUMBER OF BITS | 1 | 2 | 3 | | |
| K_01-TH SUBFRAME | PREDICTION COEFFICIENT | 4 | 5 | 6 | | |
| K_02-TH SUBFRAME | PREDICTION COEFFICIENT | 7 | 8 | 9 | | |
| ⋮ | | | | | | |
| K_09-TH SUBFRAME | OTHERS | 28 | 29 | 30 | | |
| (K+1)_00-TH SUBFRAME | NUMBER OF BITS | 1 | 2 | 3 | 4 | |
| (K+1)_01-TH SUBFRAME | PREDICTION COEFFICIENT | 5 | 6 | 7 | 8 | |
| ⋮ | | | | | | |
| L_00-TH SUBFRAME | NUMBER OF BITS | 1 | 2 | 3 | 4 | 5 | 6 |
| ⋮ | | | | | | |
| M_00-TH SUBFRAME | NUMBER OF BITS | 1 | 2 | | | |
| ⋮ | | | | | | |

FIG. 14

COMPRESSED DATA STRUCTURE AND APPARATUS AND METHOD RELATED THERETO

CROSS REFERENCE TO RELATED APPLICATION

This application is a division of U.S. patent application Ser. No. 10/676,205 filed on Sep. 30, 2003, the entire contents of which are incorporated herein by reference.

BACKGROUND OF THE INVENTION

The present invention relates to a structure of memory-stored compressed waveform data for use in tone generation apparatus etc., a tone generation apparatus for generating tones by reading out the compressed waveform data, and a waveform storage processing apparatus for writing compressed waveform data into a memory. The present invention also relates to a waveform data compression method, tone signal generation method and tone signal processing apparatus and program which are suitable for use in tone generation apparatus that store waveform data after compressing the waveform data on a frame-by-frame basis and reproduce the stored waveform data on the basis of performance information.

Among the conventionally-known tone signal generation methods for use in electronic musical instruments is the PCM method which prestores, in a memory, digital waveform sample data obtained by successively sampling and digitizing instantaneous values of tone waveforms of a natural musical instrument and then, at the time of tone reproduction, generates tone signals by reading out the prestored waveform sample data. The PCM method can advantageously generate tones very close to those of a natural musical instrument, but disadvantageous in that the memory for storing the waveform sample data must have an enormous storage capacity. To avoid such a problem presented by the PCM method, there have been proposed a tone signal generation apparatus which compresses samples of waveform data, stores the compressed waveform data in a memory and then, at the time of tone reproduction, forms tone signals by decompressing the stored compressed waveform data (e.g., Japanese Patent No. 2605434).

In the proposed tone signal generation apparatus, the storage capacity of the memory can be used efficiently because the memory stores the compressed waveform sample data. Specifically, the waveform sample data to be stored in the memory are compressed into a variable length, divided or segmented into frames each composed of a fixed number (e.g., 16 samples) of the compressed waveform data, and then stored in the memory on a frame-by-frame basis. Therefore, the total number of bits in each of the frames is variable depending on the number of bits per sample of the compressed waveform data. In this case, where each of the frames has a variable length, respective start positions, in the memory, of the frames differ considerably. Thus, there arises a need for a circuit to calculate the respective leading addresses of the frames, which would greatly complicate the construction of circuitry for decompressing the compressed waveform data.

According to the frame-by-frame compression scheme, the waveform data are segmented into predetermined frame sections and compressed on the frame-by-frame basis, in order to reduce the storage capacity for storing the waveform data in a waveform-memory tone generator apparatus. Various waveform data coding schemes or techniques have been known, of which the "linear prediction technique" is used extensively today because it can achieve a high compression efficiency and reduce processing loads at the time of tone reproduction. Note that the linear prediction technique is a technique for determining a predicted value of each sample of interest on the basis of several sample values preceding the sample of interest and predetermined generating polynomial expression and then recording, as difference data, a difference between the predicted value and a corresponding actual value.

In reproduction of waveform data, it is conventional to reproduce a leading portion, i.e. attach portion, of the waveform data only once and then repeatedly reproduce the remaining portion, i.e. loop portion of the waveform data (loop reproduction). Therefore, it is necessary to identify in advance loop start and end points of a loop portion in a succession of frames which are the first and last sampling points of the loop portion. In the past, the frame-by-frame compression scheme would present the problem that the loop start and end points are restricted to boundary positions of the frames because of the necessity to reproduce the waveform data on the frame-by-frame basis. Namely, because the loop start point and loop end point can not be set at appropriate sampling points, there would arise the problem that undesired noise is produced due to discontinuity in signal level and phase when the waveform data reproduction shifts from the loop end point back to the loop start point.

Japanese Patent No. 2674155 discloses a technique designed to prevent such undesired noise, which, once given points of waveform data are designated as loop start and loop end points, performs time-axial adjustment (compression, expansion or shift in the time-axial direction) on the entire waveform data so as to allow the loop start and loop end points to coincide with frame boundaries.

However, with the technique disclosed in the No. 2674155 patent, there would be encountered the problems that the quality of the waveform data deteriorates during the time-axial compression or expansion and the necessary amount of processing becomes enormous because the processing is performed on all of the waveform data. Further, in the disclosed conventional technique, where header information for decompression compression codes is stored at the beginning of each frame, it is necessary to read out all of the header information of the frames before initiation of the decompression process. Therefore, during the course of the decompression process on a given frame, a sufficient time has to be secured for reading out in advance the header information of the next frame. Because the disclosed conventional technique is based on decompression of all of the compression codes per frame, it may readily secure such a time. However, if the data structure disclosed in the patent is employed in an "apparatus capable of setting a loop start point or loop end point partway through a frame (i.e., at an enroute point of the frame)", in other words "apparatus where a reproducing time of a proportion of the frames can be extremely short", there can not be secured a sufficient time for reading out in advance the header information.

SUMMARY OF THE INVENTION

In view of the foregoing, it is an object of the present invention to provide an improved compression data structure, waveform generation apparatus and waveform storage processing apparatus which permit a data expansion process on waveform data with a simple construction.

It is another object of the present invention to provide an improved waveform data compression method, tone signal generation method and tone signal processing apparatus and program which achieve enhanced flexibility in designating a loop portion of waveform data and yet can perform high-quality loop reproduction with simple processing.

According to a first aspect of the present invention, there is provided a compressed data structure for segmentation of a plurality of samples of compressed waveform data into a plurality of frames and subsequent storage of the frames. In the compressed data structure of the present invention, the number of bits per sample of the compressed waveform data is variable between the frames, but uniform (i.e., the same among all the samples) within each of the frames, each of the frames has a same data storage size, and each of the frames includes, in a predetermined layout, an auxiliary information area for storing auxiliary information that includes compression-related information to be used for decompressing the compressed waveform data, and a data area for storing a plurality of samples of the compressed waveform data of the frame, each of the samples in the frame comprising a same number of bits.

There is also provided a tone generation apparatus using such an inventive compressed data structure, which comprises: a storage section that stores a plurality of samples of compressed waveform data segmented into a plurality of frames. Here, the number of bits per sample of the compressed waveform data is variable between the frames, but uniform (i.e., the same among all of the samples) within each of the frames, each of the frames having a same data storage size, each of the frames including, in a predetermined layout, an auxiliary information area for storing auxiliary information that includes compression-related information to be used for decompressing the compressed waveform data and a data area for storing a plurality of samples of the compressed waveform data of the frame, each of the samples comprising a same number of bits. The tone generation apparatus further comprises: a number-of-bits designation section that designates the number of bits per sample of the compressed waveform data for each of the frames stored in the storage section; a readout section that designates any one of the frames to be read out and reads out stored data of the designated frame from the storage section; a retrieval section that, of the data of the frame read out by the readout section, retrieves the auxiliary information from the auxiliary information area and retrieves the samples of the compressed waveform data from the data area in accordance with the number of bits per sample designated by the number-of-bits designation section; a decoding section that decompresses each of the samples of the retrieved compressed waveform data, using the compression-related information included in the retrieved auxiliary information; and a tone generation section that generates a tone on the basis of the waveform data decompressed by the decoding section.

According to the first aspect of the invention, the total number of bits in each of the frames is fixed uniformly. Thus, the respective start positions of the frames can be set at fixed positions spaced from each other at uniform intervals, so that the first or leading address of any one of the frames can be acquired with ease. As a consequence, the waveform data can be stored with an increased efficiency, and the circuit for performing the decompression process can be significantly simplified in construction. Also, the auxiliary information, constituting the frame along with the compressed waveform data, includes compression-related information, so that the compressed waveform data can be decompressed using the compression-related information. Note that the number of bits per sample of the compressed waveform data is uniform within the frame. By setting the number of bits per sample to an integer multiple of a prime number of the number of bits present in the fixed-length data area storing the compressed waveform data, the compressed waveform data can be stored efficiently with no waste bit.

According to a second aspect of the present invention, there is provided a compressed data structure suited for segmentation of a plurality of samples of compressed waveform data into a plurality of frames and subsequent storage of each of the frames into a memory capable of storing n bits per address. Here, the number of bits per sample of the compressed waveform data is variable between the frames but uniform within each of the frames, each of the frames of the compressed waveform data is stored over a predetermined number j of successive addresses of the memory, and k samples of the compressed waveform data of the frame are stored at m bits of the n bits (where $m<n$) in each of the j addresses, and an auxiliary information area storing auxiliary information that includes compression-related information to be used for decompressing the compressed waveform data is stored at the remaining $(n-m)$ bits in the address.

The present invention also provides a waveform generation apparatus using such an inventive compressed data structure, which comprises: a storage device storing a plurality of frames of compressed waveform data having the above-mentioned compressed data structure; an address generation section that generates, every sampling cycle, a readout address varying at a predetermined rate corresponding to a designated tone pitch; a readout section that generates a memory address incrementing by one each time the readout address increments by a value, and accesses the storage device with the memory address to thereby read out data of n bits from the storage device; an auxiliary information retrieval section that retrieves the data of $(n-m)$ bits from the data of the n bits, read out by the read out section, to thereby output auxiliary information including compression information; a temporary storage section that retrieves the data of the m bits from the read-out data of the n bits and stores the retrieved data of the m bits; and a waveform generation section that accesses the temporary storage section with the readout address to thereby sequentially read out k samples of compressed waveform data, performs a decompression process, on the basis of the compression information outputted by the auxiliary information retrieval section and the sequentially-read-out samples of compressed waveform data, to thereby restore samples of original waveform data, and generates a tone waveform on the basis of the restored samples of original waveform data.

According to the second aspect of the present invention, each of the frames of the compressed waveform data is stored over a predetermined number j of successive addresses of the memory, and k samples of the compressed waveform data of the frame are located at m bits of the n bits storable in each of the j addresses, and the auxiliary information is located at the remaining $(n-m)$ bits in the address. In this way, respective start positions of the frames of a fixed length can be set at fixed positions spaced from each other at uniform intervals, and also respective start positions of the compressed waveform data and auxiliary information can be set at fixed positions spaced from each other at uniform intervals. Also, respective start positions of the k samples of the compressed waveform data can be set at fixed positions spaced from each other at uniform intervals. As a result, the construction for reading out samples of the compressed waveform data and performing the decompression process on the read-out samples can be simplified significantly. Namely, the compressed waveform data read out with the simplified construction can be decompressed using the auxiliary information indicative of a form of the compression process and read out with the simplified construction. Further, preferably, the number of bits i for each of the k samples of the compressed waveform data is set to an integer multiple of a prime number of the m bits allocated as a fixed length, so that the compressed waveform data can be stored in memory efficiently with no waste bit.

According to a third aspect of the present invention, there is provided a waveform data compression method, which comprises: a step of segmenting waveform data comprising a plurality of sample value into a plurality of portions; a step of setting a loop start point and loop end point in the waveform data in such a manner that at least one of the loop start point and loop end point is set at an enroute (i.e., intermediate) point of the portion to which the start point or end point belongs; and a step of forming frame data of each of the portions by compressing the waveform data for each of the portions, wherein the portion having the loop start point or loop end point set at the enroute point thereof is compressed so as to have same decompression parameters as another portion preceding or following said portion.

According to an embodiment of the third aspect of the present invention, the step of setting a loop start point and loop end point in the waveform data may includes: a step of setting a provisional loop start point and provisional loop end point in the waveform data; a step of setting the loop end point at a last sampling point in the portion to which the provisional loop end point belongs; a step of setting the loop start point at a sampling point located behind and spaced apart from the provisional loop start point by a distance equivalent to a total number of samples present between the provisional loop end point and the loop end point; and a step of copying the sample values from the provisional loop start point to a sampling point immediately preceding the loop start point, as sample values from a sampling point immediately following the provisional loop end point to the loop end point.

According to the embodiment of the third aspect of the present invention, the step of forming frame data of each of the portions may includes: a first determination step of applying same decompression parameters to two particular portions that comprise a loop start portion including the loop start point and either a loop end portion including the loop end point or a portion to be reproduced following the loop start portion, and determining, for each of the two particular portions, compression codes capable of being decompressed with the same decompression parameters; a second determination step of, on the basis of the waveform data of each of other portions than the two particular portions, determining decompression parameters for the other portion and compression codes for the other portion which are capable of being decompressed with the decompression parameters determined for the other portion; and a frame formation step of forming data of a frame on the basis of the compression codes of the sample values in a corresponding one of the portions and the decompression parameters for decompressing the compression codes of the portion to be reproduced following the one portion.

According to another embodiment of the third aspect of the present invention, the step of setting a loop start point and loop end point in the waveform data may includes: a step of setting a provisional loop start point and provisional loop end point in the waveform data; a step of setting the loop start point at a leading sampling point of the portion following the portion to which the provisional loop start point belongs; a step of setting the loop end point at a sampling point located behind and spaced apart from the provisional loop end point by a distance equivalent to a total number of samples present between the provisional loop start point and the loop start point; and a step of copying the sample values from the provisional loop start point to a sampling point immediately preceding the loop start point, as sample values from a sampling point immediately following the provisional loop end point to the loop end point.

According to the other embodiment of the third aspect of the present invention, the step of forming frame data of each of the portions may includes: a first determination step of applying same decompression parameters to two particular portions that comprise a loop end portion including the loop end point and either a loop start portion including the loop start point or a portion to be reproduced before the loop start portion, and determining, for each of the two particular portions, compression codes capable of being decompressed with the same decompression parameters; a second determination step of, on the basis of the waveform data of each of other portions than the two particular portions, determining decompression parameters for the other portion and compression codes for the other portion which are capable of being decompressed with the decompression parameters determined for the other portion; and a frame formation step of forming data of a frame on the basis of the compression codes of the sample values in a corresponding one of the portions and the decompression parameters for decompressing the compression codes of the portion to be reproduced following the one portion.

According to a fourth of the present invention, there is also provided a tone signal generation method for generating a tone signal by use of a memory storing a plurality of frames each including compression codes obtained by compressing waveform data over a portion thereof and decompression parameters for decompressing the compression codes of a next portion, which comprises: a step of generating readout addresses in such a manner that the readout addresses vary at a rate corresponding to a pitch of a tone signal to be generated; a readout step of reading out data of the frames from said memory on the basis of the readout addresses generated by said step of generating; a decompression step of decompressing the compression codes of a particular portion included in any one of the frames read out by said readout step, on the basis the decompression parameters of said particular portion having been included in a previously-read-out frame, to thereby reproduce a tone signal; and a loop control step of, on condition that the readout address has reached a loop end point, setting the readout address at a loop start point, wherein at least one of a loop start point and loop end point is set at an enroute point of the portion to which the start point or end point belongs, and the portion having the loop start point or loop end point set at the enroute point thereof has same decompression parameters as another portion preceding or following said portion.

According to an embodiment of the fourth aspect of the present invention, on condition that the readout address has reached the loop end point that is a last sampling point of a predetermined loop end frame, the loop control step may perform to set the readout address at the loop start point that is an enroute sampling point in a predetermined loop start frame.

According to the embodiment of the fourth aspect of the present invention, the decompression step may include: a step of, when the loop start frame is read out for the first time by the readout step, decompressing the compression codes of the loop start frame on the basis of the decompression parameters included in the frame read out immediately before the loop start frame; a step of, when the loop start frame is read out for the second time or at a later time by the readout step, decompressing the compression codes of the loop start frame on the basis of the decompression parameters applied to decompression of the compression codes of the loop end frame; a step of, when the frame following the loop start frame is read out for the first time by the readout step, decompressing the compression codes of the frame following the loop start frame on the basis of the decompression parameters included in the loop start frame; a step of, when the frame following the loop start frame is read out for the second time or at a later time by the readout step, decompressing the compression codes of the frame following the loop start frame on the basis of the decompression parameters included in the loop end frame; and a step of, when another of the frames is read out by the readout step, decompressing the compression codes of the other frame on the basis of the decompression parameters included in the frame read out immediately before the other frame.

The decompression step may include: a step of, when the frame following the loop start frame is read out for the first time by the readout step, decompressing the compression codes of the frame following the loop start frame on the basis of the decompression parameters included in the loop start frame; a step of, when the frame following the loop start frame is read out for the second time or at a later time by the readout step, decompressing the compression codes of the frame following the loop start frame on the basis of the decompression parameters included in the loop end frame; and a step of, when another of the frames is read out by the readout step, decompressing the compression codes of the other frame on the basis of the decompression parameters included in the frame read out immediately before the other frame.

According to another embodiment of the fourth aspect of the present invention, on condition that the readout address has reached the loop end point that is an enroute point of a predetermined loop end frame, the loop control step may perform to set the readout address at the loop start point that is a leading sampling point in a predetermined loop start frame.

The present invention may be constructed and implemented not only as the apparatus (or method) invention as discussed above but also as a method (or apparatus) invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIG. 8 is a diagram showing examples of data structures in accordance with an embodiment embodying a first aspect of the present invention;

FIG. 14 is a diagram showing an example data format of various frames;

DETAILED DESCRIPTION OF THE EMBODIMENTS

Figure 1:
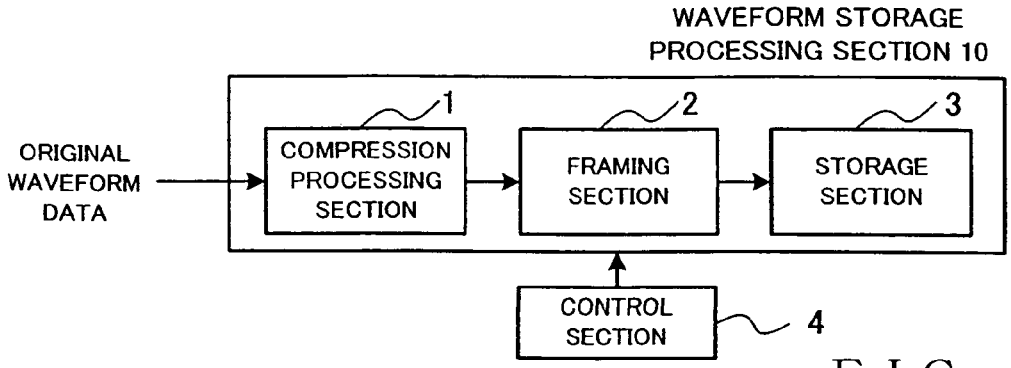
FIG. 1 is a block diagram showing a general setup of a waveform storage processing apparatus in accordance with an embodiment of the present invention.

FIG. 1 is a block diagram showing a general setup of a waveform storage processing apparatus in accordance with an embodiment of the present invention.

As shown, the waveform storage processing apparatus includes a waveform storage processing section 10 and a control section 4. The waveform storage processing section 10 includes a compression processing section 1 for compressing input original waveform data into compressed waveform data of a variable length, framing (i.e., frame formation) section 2 for segmenting the compressed waveform data into a plurality of frames and classifying the segmented compressed waveform data of each of the frames as frame data along with auxiliary information, and a storage section 3 in which the data of each of the frames classified by the framing section 2 are written and stored. The control section 4 controls waveform storage processing, performed by the waveform storage processing section 10, to variably control, for each of the frames, the number of bits per sample of the compressed waveform data, and also controls a waveform data compression process so that the number of bits per sample of the compressed waveform data is uniform within each of the frames. The compression processing section 1 is capable of performing the compression process using either the adaptive differential pulse code modulation (ADPCM) scheme or the linear predictive coding (LPC) scheme.

Figure 2:
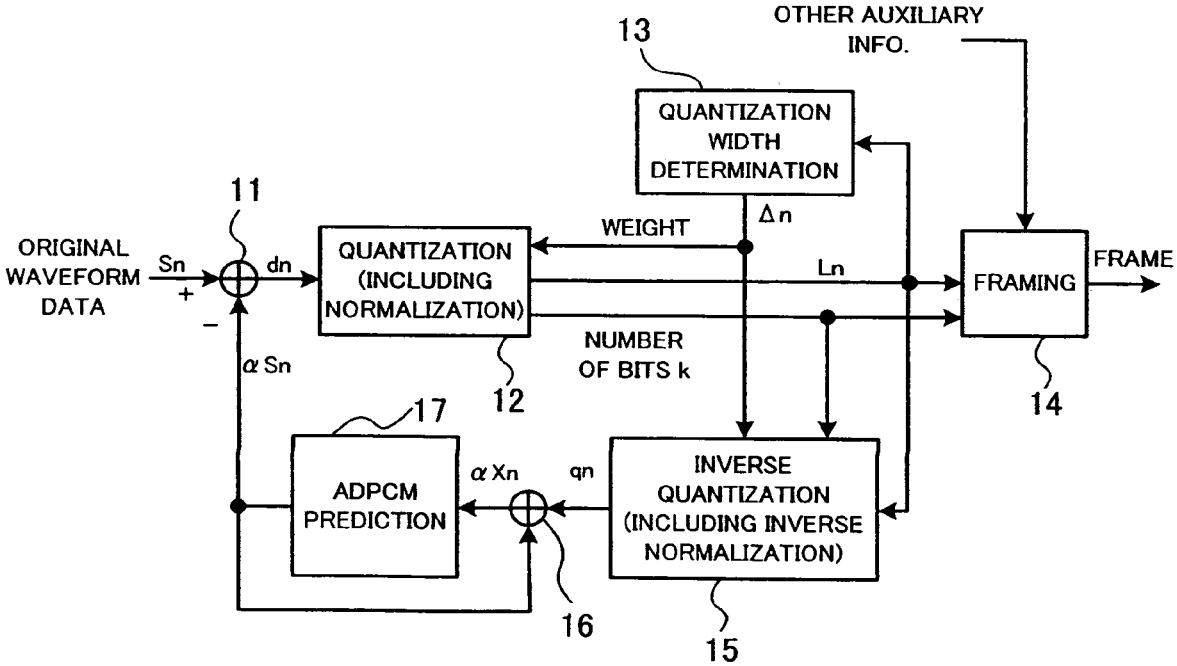
FIG. 2 is a block diagram showing an example setup of a compression processing section of the waveform storage processing apparatus which performs a compression process using the ADPCM scheme.

FIG. 2 is a block diagram showing an example setup of the compression processing section 1 which performs the compression process using the ADPCM scheme.

In FIG. 2, original waveform data Sn is input to a subtractor 11 so that the value of a prediction signal αSn output from an ADPCM prediction section 17 is subtracted from the value of the original waveform data Sn, and the subtractor 11 outputs a difference signal dn indicative of the difference (dn=Sn−αSn). The difference signal dn is passed to a quantization section 12, where a specific number of bits k is determined while the level of the difference signal dn is being quantized (normalized) on the basis of a quantization width signal Δn and the difference signal dn is converted into compressed waveform data Ln having the determined number of bits k by being coded in accordance with the number of bits k. Quantization width determination section 13 determines a quantization width on the basis of the current compressed waveform data Ln and previous compressed waveform data, so as to output a quantization width signal Δn indicative of an optimal quantization width. The quantization width signal Δn is supplied, as a weight, to the quantization section 12. The compressed waveform data Ln is also supplied to an inverse quantization section 15, which performs inverse quantization (including inverse normalization) on the supplied compressed waveform data Ln on the basis of the quantization width signal Δn and then outputs a decoded signal qn of the compressed waveform data Ln. The decoded signal qn is delivered to an adder 16, where a prediction signal αSn output from the ADPCM prediction section 17 is added to the decoded signal qn to generate reproduced waveform data αXn and the resultant sum is supplied to the prediction section 17. The ADPCM prediction section 17 generates a prediction signal αSn for the current sample using p (which is an integral number) previous reproduced waveform data αXn−p, αXn−p+1, . . . , αXn−1.

The compression process is performed in the above-described manner per sample of the original waveform data, so that compressed waveform data are output and supplied sequentially from the quantization section 12 to a framing (frame formation) section 14. The framing section 14 forms a frame, having a fixed length with a fixed total number of bits, using the compressed waveform data sequentially supplied from the quantization section 12 to the framing section 14 and the auxiliary information including information indicative of the number of bits k and other information. In this case, the frame has a fixed auxiliary information area allocated to the auxiliary information and a remaining data area allocated to the compressed waveform data. Specifically, the compressed waveform data are sequentially packed into the allocated data area, to constitute the frame together with the auxiliary information. The frames thus formed by the framing section 14 are output and written into the storage section, one by one, i.e. on a frame-by-frame basis. Note that the number of bits per sample of the compressed waveform data is uniform (i.e., the same for all the samples) within the frame, but variable among the frames.

Figure 3:
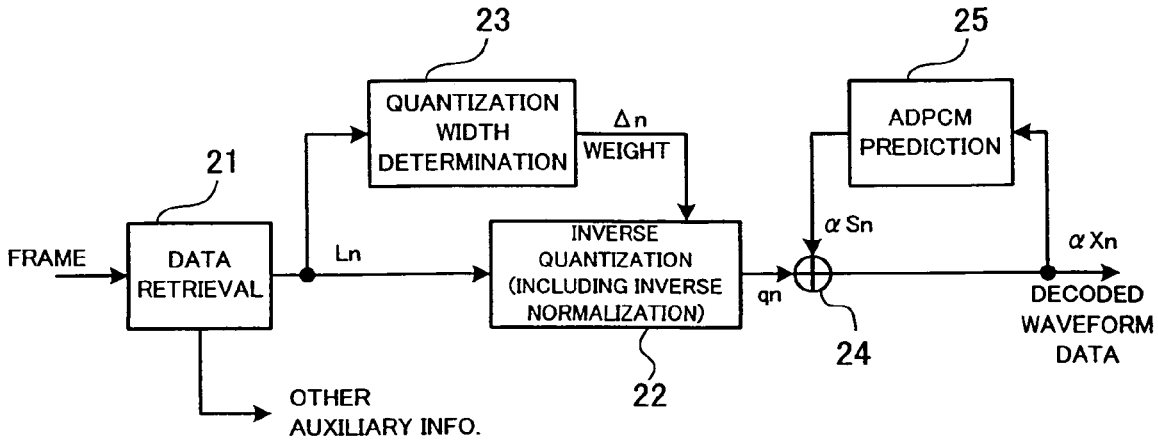
FIG. 3 is a block diagram showing an example setup of an ADPCM decoder that decompresses compressed waveform data segmented into frames.

FIG. 3 is a block diagram showing an example setup of a decoder that decompresses the compressed waveform data formed into frames in the above-described manner.

In FIG. 3, a data retrieval section 21, to which each frame read out from the storage section is supplied, retrieves the auxiliary information from the fixed auxiliary information area of the frame and determines the number of bits of the compressed waveform data of the frame on the basis of the number-of-bits information included in the retrieved auxiliary information. Then, the data retrieval section 21 sequentially extracts the compressed waveform data Ln from the data area of the frame on the basis of the determined number of bits and supplies the thus-extracted compressed waveform data to an inverse quantization section 22. Each of the compressed waveform data Ln is also supplied to a quantization width determination section 23, which determines a quantization width on the basis of the current compressed waveform data Ln and previous compressed waveform data, and it outputs a quantization width signal Δn indicative of an optimal quantization width. The quantization width signal Δn is supplied, as a weight, to the inverse quantization section 22, which performs inverse quantization (including inverse normalization) on the supplied compressed waveform data Ln on the basis of the quantization width signal Δn output from the quantization width determination section 23 and then outputs a decoded signal qn of the compressed waveform data Ln. The decoded signal qn is delivered to an adder 24, where a prediction signal αSn output from an ADPCM prediction section 25 is added to the decoded signal qn to generate reproduced waveform data αXn that is supplied as decoded waveform data. The reproduced waveform data αXn is also sent to an ADPCM prediction section 25, which generates a prediction signal αSn to be used for reproducing the current sample using p (which is an integral number) previous reproduced waveform data αXn−p, αXn−p+1, αXn−1.

Thus, a reproduced sound can be acquired by generating a sound signal on the basis of the decoded waveform data output from the decoder. In the case where the original data are tone waveform data, there can be generated a tone on the basis of the output decoded waveform data. Note that the data retrieval section 21 also outputs other auxiliary information; thus, if the output auxiliary information is used as loop addresses for tone volume information and waveform data, there can be generated a tone using the loop addresses.

Figure 4:
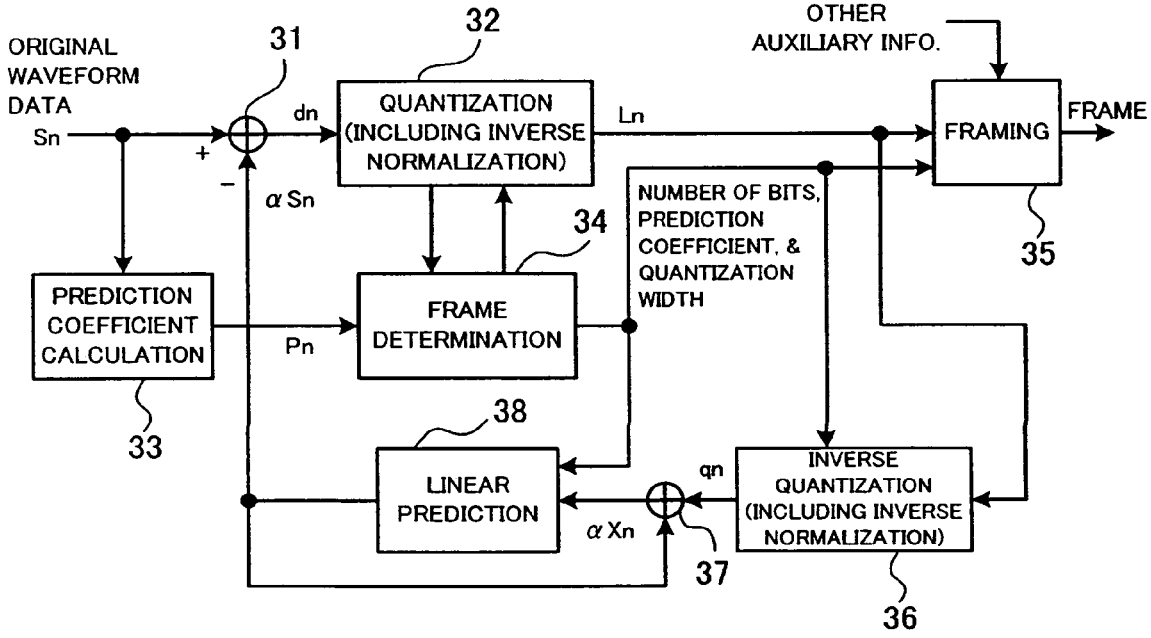
FIG. 4 is a block diagram showing an example setup of a compression processing section of the waveform storage processing apparatus which performs a compression process using the LPC scheme.

FIG. 4 is a block diagram showing an example setup of the compression processing section 1.

In FIG. 4, original waveform data Sn are input to a prediction coefficient calculation section 33, which calculates prediction coefficients Pn (p (which is an integral number) prediction coefficients or index indicative of the p prediction coefficients) on the basis of samples of the original waveform data for a predetermined time period corresponding to a frame and using linear prediction coefficient calculations such as auto-correlation. The prediction coefficient calculation section 33 outputs the thus-calculated prediction coefficients Pn to a frame determination section 34. Further, a linear prediction signal αSn output from a linear prediction section 38 is subtracted from the original waveform data Sn input to a subtractor 31, so that the subtractor 31 outputs a difference signal dn indicative of the difference (dn=Sn−αSn). The difference signal dn is passed to a quantization section 32, where it is coded while its level is being quantized (normalized) on the basis of a designated quantization width signal and designated number of bits, and then it is converted into compressed waveform data Ln having the designated number of bits. The compressed waveform data Ln is supplied to an inverse quantization section 36, where inverse quantization (including inverse normalization) is performed on the supplied compressed waveform data Ln on the basis of a designated quantization width signal and designated number of bits so that a decoded signal qn of the compressed waveform data Ln is output. The decoded signal qn is delivered to an adder 37, where a linear prediction signal αSn output from the linear prediction section 38 is added to the decoded signal qn to generate reproduced waveform data αXn that is sent back to the linear prediction section 38. The linear prediction section 38 performs linear prediction calculations on the basis of p (which is an integral number) previous reproduced waveform data αXn−p, αXn−p+1, . . . , αXn−1, to generate a linear prediction signal αXn of the current sample.

For each frame of the original waveform data, the compression processing section 1 performs linear prediction compression in a plurality of different ways each using a different number of bits, different coefficients or different quantization width, and the frame determination section 34 determines a specific number of bits, prediction coefficients and quantization width to be used for compression of the frame on the basis of the results of the compression processes performed. The quantization section 32 performs quantization on the basis of the thus-determined number of bits, prediction coefficients and quantization width, to thereby generate compressed waveform data Ln. In this case, the frame determination section 34 provisionally determines a specific number of bits on the basis of previous numbers of bits, and then the prediction coefficient calculation section 33 supplies prediction coefficients Pn corresponding to one frame of the original waveform data that are to be compressed in accordance with the provisionally-determined number of bits. Then, the frame determination section 34 provisionally determines a quantization width on the basis of previous quantization widths, the linear prediction section 38 performs linear prediction based on the prediction coefficients Pn and the quantization section 32 performs quantization based on the provisionally-determined number of bits and quantization width, so as to generate compressed waveform data Ln. Then, a comparison is made between reproduced waveform data generated by the above provisional linear prediction compression process (i.e., reproduced waveform data output from the adder 37) and the original waveform data, so as to calculate a distortion rate of the reproduced waveform data. Then, on the basis of the results of the provisional linear prediction compression process having been performed in a plurality of different ways, a combination of the number of bits, prediction coefficients and quantization width is determined, for each frame, which achieves an optimal compression rate with the distortion rate falling within a predetermined permissible range.

Then, using the number of bits, prediction coefficients and quantization width having been determined per frame in the above-described manner, the compression process is performed, sample by sample, on the frame of the original waveform data, and resultant compressed waveform data are sequentially output from the quantization section 32 to a framing section 35. The framing section 35 forms frames, each having a fixed length with a fixed total number of bits, using the compressed waveform data sequentially supplied from the quantization section 32 to the framing section 35, auxiliary information including information indicative of determined prediction coefficients, number of bits and quantization width and other auxiliary information. In this case, the frame has a fixed auxiliary information area allocated to the auxiliary information and the remaining data area allocated to the compressed waveform data. Specifically, the compressed waveform data are sequentially packed into the allocated data area, to constitute the frame together with the auxiliary information. The frames thus formed by the framing section 35 are output and written into the storage section on the frame-by-frame basis. Note that the prediction coefficients, number of bits and quantization width of the compressed waveform data may be made variable on the frame-by-frame basis.

Figure 5:
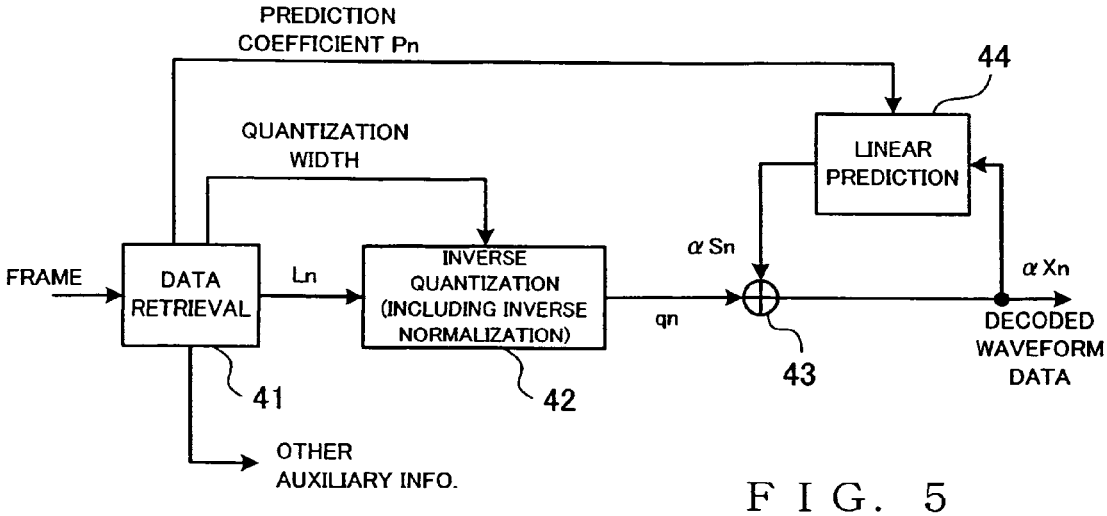
FIG. 5 is a block diagram showing an example setup of an LPC decoder that decompresses compressed waveform data segmented into frames.

FIG. 5 is a block diagram showing an example setup of a decoder that decompresses the compressed waveform data formed into frames in the above-described manner.

In FIG. 5, a data retrieval section 41, to which each frame read out from the storage section is supplied, retrieves the auxiliary information from the fixed auxiliary information area of the frame and also sequentially retrieves the compressed waveform data from the fixed data area of the frame on the basis of the number-of-bits information included in the auxiliary information, so as to supply the retrieved information and waveform data to an inverse quantization section 42. Further, the data retrieval section 41 extracts prediction coefficient information Pn from the auxiliary information to supply the extracted prediction coefficient information Pn to a linear prediction section 44, and it also extracts quantization width information from the auxiliary information to supply the extracted quantization width information to the inverse quantization section 42. The inverse quantization section 42, which performs inverse quantization (including inverse normalization) on the supplied compressed waveform data Ln on the basis of the quantization width information supplied from the data retrieval section 41 and then outputs a decoded signal qn of the compressed waveform data Ln. The decoded signal qn is delivered to an adder 43, where a prediction signal αSn output from the linear prediction section 44 is added to the decoded signal qn to generate reproduced waveform data αXn that is supplied as decoded waveform data. The reproduced waveform data αXn is also sent to the linear prediction section 44, which generates a prediction signal αSn for the current sample by performing linear prediction calculations based on p (which is an integral number) previous reproduced waveform data αXn−p, αXn−p+1, . . . , αXn−1.

Thus, a reproduced sound can be acquired by generating a sound signal on the basis of the decoded waveform data output from the decoder. In the case where the original data are tone waveform data, there can be generated a tone on the basis of the output decoded waveform data. Note that the data retrieval section 41 also outputs other auxiliary information; thus, if the output auxiliary information is set as loop addresses for tone volume information and waveform data, there can be generated a tone using the loop addresses.

FIG. 8 is a diagram showing examples of inventive data structures of frames each comprising compressed waveform data and auxiliary information stored in the storage section 3.

Specifically, FIG. 8 shows example data structures of frames where each sample of compressed waveform data consists of two bits, three bits, four bits, five bits, six bits and ten bits, respectively. Referring to the example where each sample of compressed waveform data consists of two bits, each frame has a data size corresponding to five addresses from "00" to "04" with a data length (sometimes referred to as data width) corresponding to one address being 16 bits, and thus the total number of bits in the frame is 80 bits; the total number of bits in the frame is fixed to provide a fixed length. The frame is composed of an auxiliary information area having a fixed length of 20 bits from the beginning of the frame, and a data area of a fixed length where compressed waveform data of the remaining 60 bits are stored. In this case, 11-bit prediction coefficient information, 5-bit quantization width information and 4-bit number-of-bits information is stored in the auxiliary information area, and 30 samples of compressed waveform data, having sample numbers "1"-"30", are stored in the data area with each sample compressed into two bits. In the frame, the number of bits per sample of the compressed waveform data is fixed.

Namely, because the total number of bits in the frame is fixed with the data length corresponding to one address as a minimum unit, the frame can start at a same fixed position. In the case where each frame has a data length corresponding to five addresses, the start addresses of the individual frames are located regularly, i.e. every five addresses; for example, if the first or start address of a given frame is "00", the last or end address of the given frame is "04", and the next frame starts at address "05". Further, because the auxiliary information area has a fixed length, the compressed waveform data also start at a same fixed position. Therefore, in performing the decompression process, addresses for reading out the frames can be generated with a simple construction. In each of the other examples of FIG. 8 too, the total number of bits in each frame is fixed with the data length corresponding to one address as a minimum unit, Thus, in the case where the frame has a data length corresponding to five addresses and each sample of the compressed waveform data consists of three bits as illustrated in the second block from the top of FIG. 8, 20 samples of the compressed waveform data are stored in the frame. In the case where the frame has a data length corresponding to five addresses and each sample of the compressed waveform data consists of four bits as illustrated in the third block of FIG. 8, 15 samples of the compressed waveform data are stored in the frame. Similarly, in the case where the frame has five data lengths and each sample of the compressed waveform data consists of five bits as illustrated in the fourth block of FIG. 8, 12 samples of the compressed waveform data are stored in the frame. In the case where the frame has five data lengths and each sample of the compressed waveform data consists of six bits as illustrated in the fifth block of FIG. 8, 10 samples of the compressed waveform data are stored in the frame. Further, in the case where the frame has five data lengths and each sample of the compressed waveform data consists of 10 bits as illustrated in the bottom block of FIG. 8, six samples of the compressed waveform data are stored in the frame. By thus setting the number of bits to an integer multiple of a prime number, "2", "3" or "5", of the 60 bits allocated to the compressed waveform data, the compressed waveform data can be packed into the frame with no waste.

Note that, where waveform data compressed by the ADPCM scheme are stored, there is no need to store information of prediction coefficients and quantization width, and, therefore, the region of address "00" in the data structure of FIG. 8 is unnecessary. Thus, in this case, it suffices to store, for each frame, only data corresponding to addresses "01"-"04".

Figure 6:
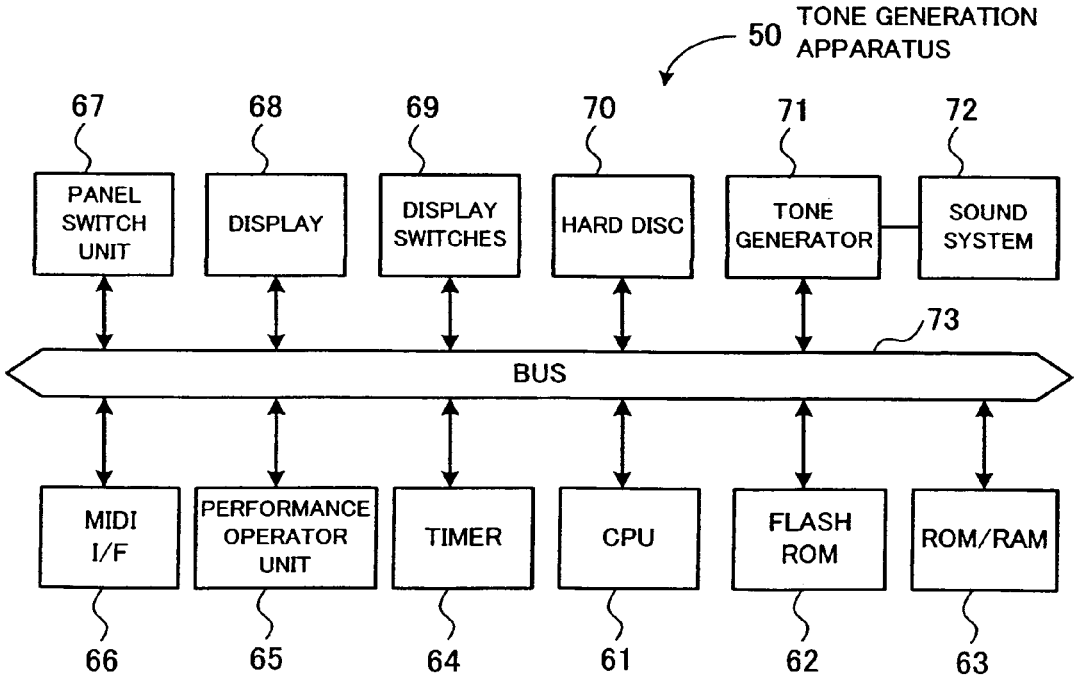
FIG. 6 is a block diagram showing a tone generation apparatus including a storage section where are stored frames of compressed waveform data having a data structure of the present invention.

FIG. 6 is a block diagram showing an embodiment of a tone generation apparatus constructed using a storage section 3 where are stored frames of compressed waveform data having the data structure of the present invention.

In the tone generation apparatus 50 of FIG. 6, a CPU (Central Processing Unit) 61 executes various tone generating programs to control tone generation processes to be performed by the apparatus 50. Timer 64 counts and indicates elapsed times during the processes, generates timer interrupt signals at specific time intervals, etc., and the outputs from the timer 64 are used for time management for an automatic performance etc. Flash ROM 62 is a rewritable read-only memory where are stored tone generation processing programs to be executed by the CPU 61 and various data such as framed compressed waveform data of the inventive data structure. ROM/RAM 63 is a main memory in the tone generation apparatus 50, which includes a RAM (Random Access Memory) having a working area set for use by the CPU 61 etc. and a ROM where are stored data such as framed compressed waveform data of the inventive data structure.

Further, in the tone generation apparatus 50 of FIG. 6, a performance operator unit 65 is, for example, in the form of a keyboard, and a MIDI interface 66 is an interface for transmitting a MIDI message, created within the tone generation apparatus 50, to the outside and receiving a MIDI message from the outside. Panel switch unit 67 includes various switches provided on a panel of the tone generation apparatus 50, and the user can give various instructions to the apparatus 50 by operating the panel switch unit 67. Display device 68 visually displays various information at the time of generation of tones. Further, the user can give various instructions to the tone generation apparatus 50 by operating display switches SW9 provided near the display device 68. Hard disk 70 is a large-capacity storage medium capable of storing framed compressed waveform data of the inventive data structure, as well as performance data, user-set data, etc.

Tone generator section 71 includes decoders constructed as shown in FIGS. 3 and 5 for decompressing framed compressed waveform data of the inventive structure, which, under control of the CPU 61, reads out, from the ROM/RAM 63, the framed compressed waveform data necessary for tone generation and then performs the decompression process on the read-out compressed waveform data. After that, the tone generator section 71 performs various processes, such as interpolation, envelope impartment, channel accumulation (mixing) and effect impartment, on the decoded waveform data, and outputs the thus-processed waveform data as tone waveform data. The tone waveform data output from the tone generator section 71 are supplied to a sound system 72, where they are converted into analog representation and audibly reproduced or sounded. The above-mentioned various components of the tone generation apparatus 50 are interconnected via a bus 73.

Figure 7:
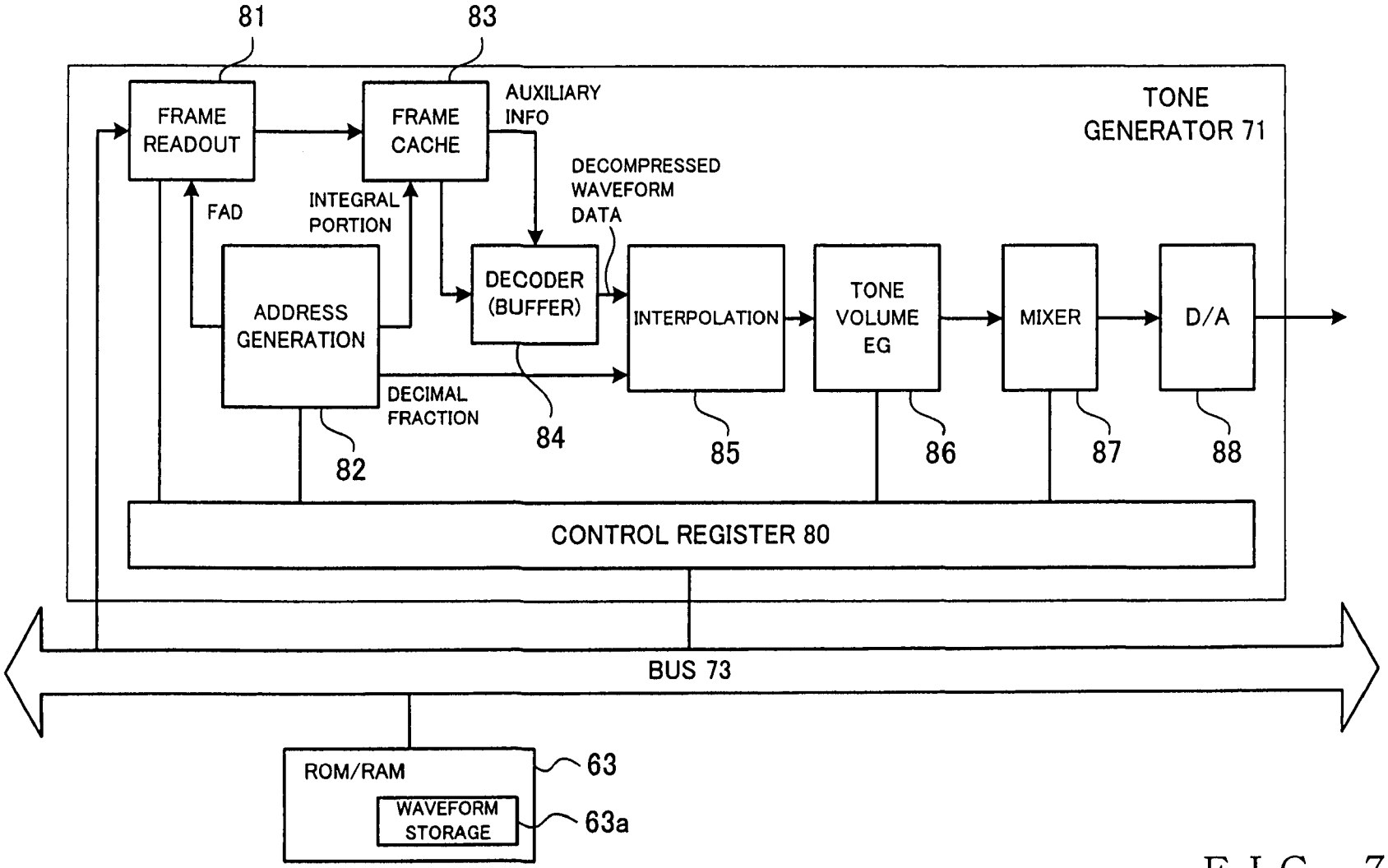
FIG. 7 is a block diagram showing a detailed construction of a tone generator section in the tone generation apparatus.

FIG. 7 is a block diagram showing a detailed construction of the tone generator section 71 in the tone generation apparatus 50.

When a tone is to be generated in response to a note-on event, the CPU 61 of the tone generation apparatus 50 selects, from among a plurality of tone generating channels, a channel to be used for (to be assigned to) generation of the tone corresponding to the note-on event, sets various tone generator parameters in a storage area of a control register 80 corresponding to the assigned tone generating channel, and issues an instruction for starting generation of the tone in the assigned tone generating channel. The tone generator parameters to be supplied to the control register 80 along with the tone generation start instruction include parameters of a waveform memory readout rate (corresponding to the pitch of the tone to be generated), particular portion of the waveform memory to be read, envelope parameters, setting information to be supplied to a mixer section 87, effect coefficient, etc. Of these, the parameters of the portion of the waveform memory to be read include a start address and data length of the compressed waveform data to be read out.

On the basis of pitch information and readout start address of each tone generating channel supplied from the control register 80, an address generation section 82 forms a frame address (FAD) to be used for reading out a frame of compressed waveform data to be read out from a waveform storage section 63*a* of the ROM/RAM 63. Specifically, pitch information in the form of an F number is accumulated every waveform data generation timing (sampling cycle) to calculate a readout address, and the frame address (FAD) is generated on the basis of the integral portion of the calculated readout address and readout start address. This frame address is supplied to a frame readout section 81, and the frame corresponding to the frame address is read out by the frame readout section 81 from the waveform storage section 63*a* of the ROM/RAM 63 and cached into a frame cache section 83. In this case, the construction of the address generation section 82 can be simplified significantly because, as illustrated in FIG. 8, the frame has a fixed length having the data length corresponding to one address as a minimum unit and the leading address of the frame is at a same fixed position. Once a frame of waveform data is newly cached into the frame cache section 83, the auxiliary information is read out from the frame cache section 83, and compression-related information necessary for the decompression process, included in the auxiliary information, is set into a decoder 84. For example, in the case where the compressed waveform data are waveform data compressed by the ADPCM scheme, information indicative of the number of bits in the compressed waveform data is set into the decoder 84; in the case where the compressed waveform data are waveform data compressed by the LPC (Linear Predictive Coding) scheme, information indicative of the number of bits in the compressed waveform data, linear prediction coefficients and quantization width is set into the decoder 84. Further, other auxiliary information than the compression-related information is sent to the control register 80 for storage therein.

Further, the integral portion of the readout address calculated by the address generation section 82 is supplied to the frame cache section 83, while the decimal fraction portion of the readout address is supplied, as interpolation information, to an interpolation section 85. The compressed waveform data read out from the frame cache section 83 in accordance with the integral portion of the readout address is supplied to the decoder 84. In an interpolation process by the interpolation section 85, the address generation section 82 generates addresses to be used for reading out, from the frame cache section 83, a particular number of samples of the compressed waveform data corresponding to an increment in the integral portion of the readout address in the current sampling cycle, and the corresponding compressed waveform data are read out to the decoder 84. The decoder 84 reproduces original waveform data by sequentially performing the decompression process on a plurality of the compressed waveform data, read out from the frame cache section 83, on the basis of the set compression-related information and p (which is an integral number) samples of decompressed waveform data currently stored in a buffer of the decoder 84 and also stores the resultant decompressed waveform data into the buffer. Note that the buffer of the decoder 84 is controlled to store therein latest p samples of the sequentially decompressed waveform data.

Thus, in the address generation section 82, an address counter of an ordinary or conventional waveform-memory tone generator can be used as-is which forms a waveform data readout address by accumulating an F number every sampling cycle. Further, even where the number of bits of compressed waveform data differs between frames, it suffices to retrieve a fixed number of bits from the fixed data area within each frame, so that the construction of the data retrieval section for retrieving compressed waveform data can be simplified to an extreme degree. In the case of the frames illustrated in FIG. 8, considerable portions of retrieving logic can be shared between two bits and four bits, three bits and six bits, and five bits and 10 bits.

In a case where two-point interpolation is to be performed by the interpolation section 85, latest two samples (or two successive samples n samples after the latest two samples) of p decompressed waveform data retained in the buffer of the decoder 84 are supplied from the buffer. Then, the two samples of compressed waveform data are read out from the frame cache section 83, decompressed by the decoder 84 and stored into the buffer. Then, interpolation is performed between the two samples of decompressed waveform data on the basis of the decimal fraction portion of a waveform data readout address supplied from the address generation section 82, so as to obtain interpolated waveform data. In a case where four-point interpolation is to be performed by the interpolation section 85, latest four samples (or four successive samples n samples after the latest four samples) of p decompressed waveform data are supplied from the buffer of the decoder 84. Then, interpolation is performed between the four samples of decompressed waveform data on the basis of the decimal fraction portion of a waveform data readout address supplied from the address generation section 82, so as to obtain interpolated waveform data.

The interpolated waveform data output from the interpolation section 85 are passed to a volume envelope generation (EG) section 86, where they are controlled in tone volume in accordance with tone volume envelope data supplied from the control register 80. Such operations are carried out for each of the tone generating channel at predetermined processing timing, so that waveform data of a plurality of the tone generating channels, having been imparted with respective envelopes generated by the volume EG section 86, are mixed by the mixer section 87. The mixed waveform data of the plurality of tone generating channels output from the mixer section 87 are converted into analog representation by a digital-to-analog converter (DAC) 88 and then supplied to the sound system 72. The mixer section 87 may perform an effect impartment process on the mixed waveform data in response to operation on the operator unit.

Whereas the present invention has been described above in relation to the case where each frame of compressed waveform data can be varied in the number of bits per sample to have a variable length per sample, the invention is not so limited. For example, the number of bits per sample may be varied every two or more frames; alternatively, the number of bits per sample may be varied per selected set of waveform data, rather than per one or more frames.

Further, whereas the present invention has been described above in relation to the case where the data length corresponding to one address in the storage section is 16 bits, the data length corresponding to one address may be 8 bits, 24 bits or the like rather than 16 bits.

Furthermore, although the present invention has been described above in relation to the case where each frame has 80 bits with 20 bits allocated to the auxiliary information and the remaining 60 bits to the compressed waveform data. The total number of bits in each frame may be other than 80 bits as long as each frame has a fixed total data length having, as its minimum unit, a data length corresponding to one address of the storage section, and the bits of the frame may be allocated to the auxiliary information and compressed waveform data at any desired ratio other than the above-mentioned, as long as the respective lengths of the auxiliary information and compressed waveform data are fixed.

Furthermore, whereas the number of bits in each frame of the compressed waveform data has been described above as being set to an integer multiple of a prime number, "2", "3" or "5", of the number of bits in the data area where the compressed waveform data are stored, the number of bits may be any other suitable number; for that purpose, the last sample of the compressed waveform data in the frame may be discarded as necessary.

In the above-described embodiment of the present invention, the size of each frame storing the compressed waveform data is fixed, and the auxiliary information and compressed waveform data are stored in the auxiliary information area and data area provided in respective fixed positions within the frame. Because the size of the data area is fixed and uniform among various frame even where the number of bits per sample of the compressed waveform data differs among the frames, the number of samples of compressed waveform data to be stored in each frame varies in accordance with the number of bits per sample of the compressed waveform data to be stored. Thus, even where the number of bits per sample of the compressed waveform data differs among various frames, the respective start positions of the frames can be located regularly at uniform intervals, so that the leading address of each of the frames can be obtained with increased ease. Further, because the stored areas of the auxiliary information and compressed waveform data are fixed uniformly in the individual frames, each desired data can be retrieved with increased ease. Therefore, the present invention can store the waveform data very efficiently and can also greatly simplify the circuit for performing the decompression process.

Figures 9, 10:
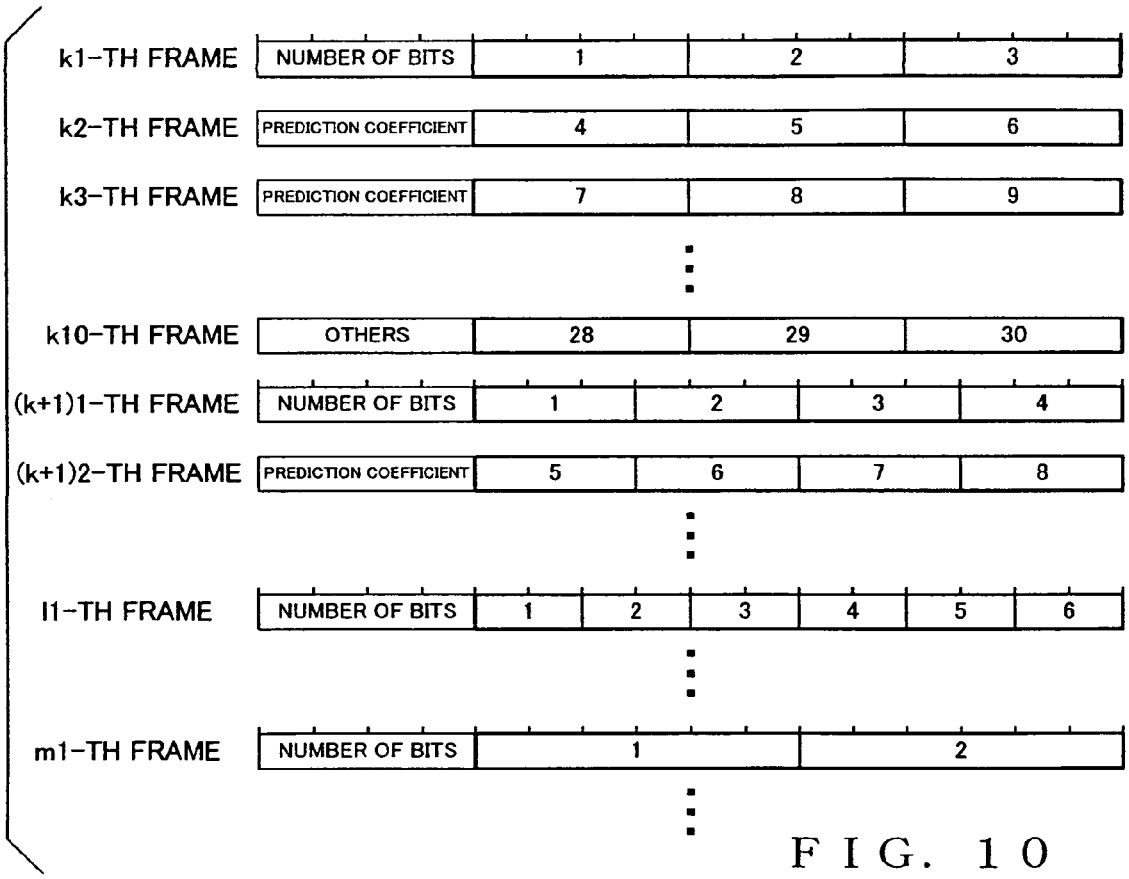
FIG. 9 is a diagram showing an example of a data structure in accordance with an embodiment embodying a second aspect of the present invention.
FIG. 10 is a diagram showing another example of the data structure in accordance with the embodiment embodying the second aspect of the present invention.

FIG. 9 shows an embodiment of a data structure of a frame including compressed waveform data and auxiliary information stored in the storage section 3 in accordance with a second aspect of the present invention.

Specifically, FIG. 9 shows an example data structure of a frame (large frame); in the illustrated example, the frame has a fixed length corresponding to ten addresses, "00" to "09". Further, in the illustrated example, the data length corresponding to one address is 16 bits, and the frame has a fixed total data size of 160 bits corresponding to ten addresses. In the frame, first (upper) four bits in each of data rows (small frames) corresponding to one of the ten addresses are set as an auxiliary information area portion, and the remaining (lower) 12 bits in each of the data rows are set as a data area portion; the auxiliary information area portions of all the data rows in the frame together constitute an auxiliary information area, and the data area portions of all the data rows in the frame together constitute a data area. The auxiliary information comprises compression-related information of compressed waveform data which, in the illustrated example, includes number-of-bit information, prediction coefficient information and quantization width information, and other information. The compression-related information of the auxiliary information is used when a decompression process is performed on compressed waveform data of a next frame.

In the illustrated example, the first four bits in the data row corresponding to address "00" constitute number-of-bits information to be used for the next frame, and the first four bits in the data rows corresponding to addresses "01" to "05" constitute prediction coefficient information (5×4 bits=20 bits) to be used for the next frame. Further, the first four bits in the data rows corresponding to addresses "06" and "07" constitute quantization width information (2×4 bits=8 bits) to be used for the next frame, and the first four bits in the data rows corresponding to addresses "08" and "09" constitute other information (2×4 bits=8 bits) to be used for generation of a tone using the next frame. Further, 30 samples of compressed waveform data of sample numbers "1" to "30", compressed into four bits per sample, are stored in the data area formed by the fifth to sixteenth bits of the individual addresses.

In the thus-constructed frame, the number-of-bit information, prediction coefficient information and quantization width information, constituting the compression-related information of the compressed waveform data, is stored in the frame; thus, the compression-related information can be set for each frame. Therefore, even where the individual frames have a same fixed length, the number of bits of the compressed waveform data to be stored in the data area of a fixed length can be varied on the frame-by-frame basis. For example, if the number of bits per sample of compressed waveform data is five, then 24 samples of waveform data can be stored in a single frame, or if the number of bits per sample of compressed waveform data is six, then 20 samples of waveform data can be stored in a single frame. However, the number-of-bit information, prediction coefficient information and quantization width information, constituting the compression-related information of compressed waveform data in each of the frames, indicates respective values that are specific to the frame. Note that the auxiliary information area in the frame has a fixed data length made up of the first four bits in the data rows corresponding to the ten addresses (i.e., 4 bits×10=40 bits).

Because each of the frame has a same fixed data size irrespective of the number of bits of the compressed waveform data, the individual frames can start at their respective fixed positions spaced apart from each other at uniform intervals. For example, in the case where each frame is constructed to correspond to 10 addresses as illustrated in FIG. 9, the respective start addresses of successive frames occur regularly every 10 addresses. Further, the start positions of the auxiliary information and compressed waveform data in the individual data rows of the frame are set to fixed positions spaced apart from each other at uniform intervals as illustrated in FIG. 9, so that addresses for reading out the auxiliary information and compressed waveform data for the decompression process can be generated with a simple construction. Further, the number of bits per sample of compressed waveform data can be varied on the frame-by-frame basis. In this case, because the number of bits of the data area in each of the frames is fixed to have a same fixed length, a particular number of samples of compressed waveform data, corresponding to the number of bits per sample of compressed waveform data, are stored in the frame. Further, by setting the number of bits per sample of compressed waveform data to a submultiple of the data area in each of the data rows, the start bits of the individual samples in the data area can be set to be the same among the data rows within the frame, so that the individual samples can be retrieved from the data rows with a simple construction.

In the storage section 3, data of a plurality of data frames, corresponding to a set of waveform data, are stored in succession in the data structure of FIG. 9, and the stored data are read out from the storage section 3 by being sequentially accessed in accordance with addresses generated by the tone generator section 7. FIG. 10 is a diagram explanatory of how the stored waveform data are read out from the storage section 3. In FIG. 10, small frames (data rows) k1-k10 of large frame k are read out sequentially, then small frames (k+1)+1, (k+1)+2, . . . , of large frame (k+1) are read out sequentially, then small frames of large frame 1 are read out sequentially at timing several frames after large frame (k+1), then small frames of large frame m are read out sequentially at timing several frames after large frame 1, and so on.

The tone generator section 7 can perform tone generation by reading out small frame k1 and performing the decompression process on the first to third samples (four bits) of large frame k. In the decompression process, the compression-related information of the auxiliary information stored in last-read-out large frame (k−1) is used. Then, to perform tone generation based on the fourth sample after having completed the tone generation based on the first to third samples of small frame k1, the tone generator section 7 newly reads out small frame k2. Further, after having completed the tone generation based on the fourth to sixth samples of small frame k2, the tone generator section 7 reads out small frame k3 to perform tone generation based on the seventh to ninth samples of the small frame. In this way, tone generation is performed sequentially on the basis of the first to thirtieth samples of large frame k.

During the tone generation based on the samples of large frame k, the auxiliary information of small frames k1-k10 sequentially read out are sequentially gathered within the interior of the tone generator section 7, so that the compression-related information of the gathered auxiliary information can be used for the decompression process of samples (three bits) of compressed waveform data of next large frame (k+1) when tone generation is to be performed on the basis of these samples.

Namely, the auxiliary information stored in large frame k includes the compression-related information to be used for decompressing the compressed waveform data of next large frame (k+1); for example, the number-of-bits information in the compression-related information in large frame k is "3" that represents the number of bits per compressed sample of the compressed waveform data in large frame (k+1).

While each of the large frames in the instant embodiment has a same fixed length as set forth above, the number of bits of compressed waveform data to be stored in the data area of a fixed length, prediction coefficients and quantization width can be varied for each of the large frames. For example, assuming that the number of bits per sample of compressed waveform data in a given frame is "3" as is the case with large frame (k+1) of FIG. 10, a total of 40 samples of compressed waveform data can be stored in the given frame. Further, assuming that the number of bits per sample of compressed waveform data is "2" as is the case with large frame 1 of FIG. 7, a total of 60 samples of compressed waveform data can be stored in the frame. Further, assuming that the number of bits per sample of compressed waveform data is "6" as is the case with large frame m of FIG. 10, a total of 20 samples of compressed waveform data can be stored in the frame. However, in the plurality of small frames in each large frame, the number-of-bit information, prediction coefficient information and quantization width information, constituting the compression-related information of compressed waveform data in the frame, is set to be the same among the small frames.

Namely, as the number of bits per sample of compressed waveform data to be stored in each large frame is varied, the number of samples of compressed waveform data to be stored in the large frame varies, but the number of small frames constituting the large frame does not vary. Therefore, the large frames will start at regular positions occurring every predetermined number of addresses. For example, in the case where the large frames each comprise ten small frames as illustratively shown in FIG. 10, the large frames start at regular positions occurring every ten addresses. Further, in the instant embodiment, the start positions of the auxiliary information and compressed waveform data in the individual small frames are also set to fixed positions spaced apart at uniform intervals, so that addresses for reading out the auxiliary information and compressed waveform data for the decompression process can be generated with a simple construction. Further, the circuit for retrieving individual data from the data rows read out with the addresses can be significantly simplified in construction. Furthermore, by setting the number of bits per sample of compressed waveform data, selectable for each of the large frames, to a submultiple (in this case, two, three or six) of the number of bits (in this case, 12 bits) in each of the data rows corresponding to the addresses, positions of one or more samples in the data area can be the same among the plurality of small frames belonging to the large frame; thus, the individual samples can be retrieved with a simple construction. Similarly, in the case where the number of bits per sample of compressed waveform data is set to two, three, four or six as illustrated in FIG. 10, the total number of bits in a large frame is set to a same fixed number of bits using, as the minimum unit, the data length corresponding to one address.

Tone generation apparatus, using the storage section 3 storing framed compressed waveform data of the data structure in accordance with a second aspect of the present invention, may be constructed in a similar manner to that shown in FIG. 6. Also, the internal construction of the tone generator section 71 in the tone generation apparatus may be similar to that shown in FIG. 7.

The following paragraphs extractively describe an example of operation of the data structure in accordance with the second aspect of the present invention, in relation to the tone generator section 71 shown in FIG. 7.

On the basis of pitch information and readout start address supplied by the control register 80 for each tone generating channel, the address generation section 82 generates small frame addresses (FADs) for reading out small frames of compressed waveform data from the waveform storage section 63*a* of the ROM/RAM 63. Specifically, the address generation section 82 generates a readout address of each frame by accumulating an F number, which represents a value proportional to the frequency (pitch information) of a tone to be generated and is composed of integral and decimal fraction portions, every waveform data generation timing corresponding to a sampling cycle, and then generates a small frame address (FAD) on the basis of the integral portion of the F number, leading address of the currently-read-out large frame and the number of bits of compressed waveform data in the large frame. The small frame address is calculated by adding the leading address to a quotient obtained by dividing the readout address by the number of samples k included in the data area of the small frame in question. The small frame address increments by one each time the readout address increments by an amount corresponding to the number of samples k. Note that the number of samples k can be determined by dividing the number of bits in the data area of the small frame by the number of bits per sample of compressed waveform data in the corresponding large frame.

The small frame address thus generated is supplied to the frame readout section 81, and the small frame corresponding to the small frame address is read out from the waveform storage section 63*a* and supplied to the frame cache section 83. The frame cache section 83 gathers the auxiliary information sequentially read out while caching the data of the data area portions of one or more last-read-out small frames, and, after completion of auxiliary information gathering of the large frame, the frame cache section 83 outputs the individual data of the thus-gathered auxiliary information to a block, such as the decoder 84, which requires the data. In this case, the auxiliary information output to the decoder 84 is compression-related information including number-of-bit information, prediction coefficient information and quantization width information. Each of the large frames comprises a same predetermined number of small frames and the leading addresses of the large frames occur at regular positions spaced from each other at uniform intervals as illustratively shown in FIG. 9, so that the construction of the address generation section 82 can be simplified to a significant degree. Further, because the data readout from the waveform storage section 63*a* is performed in small frames, the frame cache section 83 only has to have a capacity for storing one to several small frames smaller than a capacity for storing an entire large frame. When the data readout shifts to a next large frame upon completion of readout of the current frame, a readout address to be used for reading out the next large frame is generated by subtracting the number of samples of compressed waveform data stored in the next large frame from the readout address of the current large frame.

The integral portion of the readout address calculated by the address generation section 82 is supplied to the frame cache section 83, while the decimal fraction portion of the calculated readout address is supplied, as interpolation information, to the interpolation section 85. Compressed waveform data read out from the frame cache section 83 in accordance with the integral portion of the readout address are supplied to the decoder 84. Note that identification numbers imparted to the samples of the compressed waveform data in FIG. 9 or 10 represent the readout addresses ("1" to "30" in the case of large frame k). In this case, a particular number of compressed waveform data, corresponding to an increment in the integral portion of the readout address at the current sampling cycle, are read out from the frame cache section 83 to the decoder 84, on the basis of the readout addresses supplied from the address generation section 82. For example, when the readout address has incremented by two from "7" to "9" at a given sampling cycle, samples of numbers "8" and "9" of small frame k3 are read out from the frame cache section 83. The decoder 84 performs a decompression process, based on p-order linear prediction, on the compressed waveform data sequentially read-out from the frame cache section 83 to thereby reproduce the original waveform data, on the basis of the compression-related information supplied from the frame cache section 83 and already-decompressed p samples of waveform data stored in the buffer of the decoder 84. Simultaneously, the decoder 84 stores the thus-decompressed waveform data in the buffer. Note that the buffer of the decoder 84 is controlled to hold latest p samples of the sequentially decompressed waveform data.

Namely, as illustrated in FIG. 10, the data of the individual small frames are sequentially read out from the waveform storage section 63*a* and cached into the frame cache section 83. If samples of the compressed waveform data corresponding to the integral portion of the supplied readout address are stored in the frame cache section 83, the samples corresponding to the readout address are read out from the frame cache section 83, while, if no such sample stored in the frame cache section 83, a small frame address of the small frame including that sample is generated by the address generation section 82 and supplied to the frame readout section 81. In this way, the small frame storing the necessary compressed waveform data is read out from the waveform storage section 63*a* of the ROM/RAM 63 and cached into the frame cache section 83. Namely, in the case where the data area of the small frame has a size of 12 bits, the address generation section 82 calculates a small frame address FAD on the basis of the integral portion int of the readout address and the number of bit a of compressed waveform data (FAD=leading address of the large frame+int×(a/12)), so that a portion of the small frame corresponding to an increment in the integral portion of the small frame address is read out.

In this way, the address generation section 82 can use an address counter in an ordinary or conventional waveform-memory tone generator as-is which generates a waveform data readout address by accumulating the F number per sampling cycle. Also, even where the number of bits per sample of compressed waveform data differs between frames, the sizes of the data area and auxiliary information area are the same among the large frames and the sizes of the data area portion and auxiliary information area portion are the same among the small frames, the portion of the frame cache section 83 for retrieving the auxiliary information area portion and data area portion from each of the small frames can be significantly simplified in construction. Further, where an integral number of samples are contained in the data area of each of the small frame as illustrated in FIG. 9 or 10, individual sample retrieval positions in the data area can be the same between adjacent small frames within the large frame, so that the portion of the frame cache section 83 for reading out individual samples of the compressed waveform data can be significantly simplified in construction.

In the case where two-point interpolation is to be performed by the interpolation section 85, latest two samples (or two successive samples n samples after the latest two samples) of p decompressed waveform data are supplied from the buffer of the decoder 84. Then, interpolation is to be performed between the two samples of decompressed waveform data on the basis of the decimal fraction portion of a waveform data readout address supplied from the address generation section 82, so as to obtain interpolated waveform data. In the case where four-point interpolation is to be performed by the interpolation section 85, latest four samples (or four successive samples n samples after the latest four samples) of p decompressed waveform data are supplied from the buffer of the decoder 84. Then, interpolation is performed between the four samples of decompressed waveform data on the basis of the decimal fraction portion of a waveform data readout address supplied from the address generation section 82, so as to obtain interpolated waveform data.

The interpolated waveform data output from the interpolation section 85 are passed to the volume envelope generation (EG) section 86, where they are controlled in tone volume in accordance with tone volume envelope data supplied from the control register 80. Such operations are carried out for each of the tone generating channel at corresponding predetermined processing timing, so that waveform data of a plurality of the tone generating channels, having been imparted with respective envelopes generated by the volume EG section 86, are accumulated by the mixer section 87 per sampling cycle. The accumulated waveform data are output from the mixer section 87 to the DAC 88 for conversion into analog representation and then supplied to the sound system 72. The mixer section 87 may perform an effect impartment process on the waveform data in response to operation on the operator unit.

Figures 11, 13:
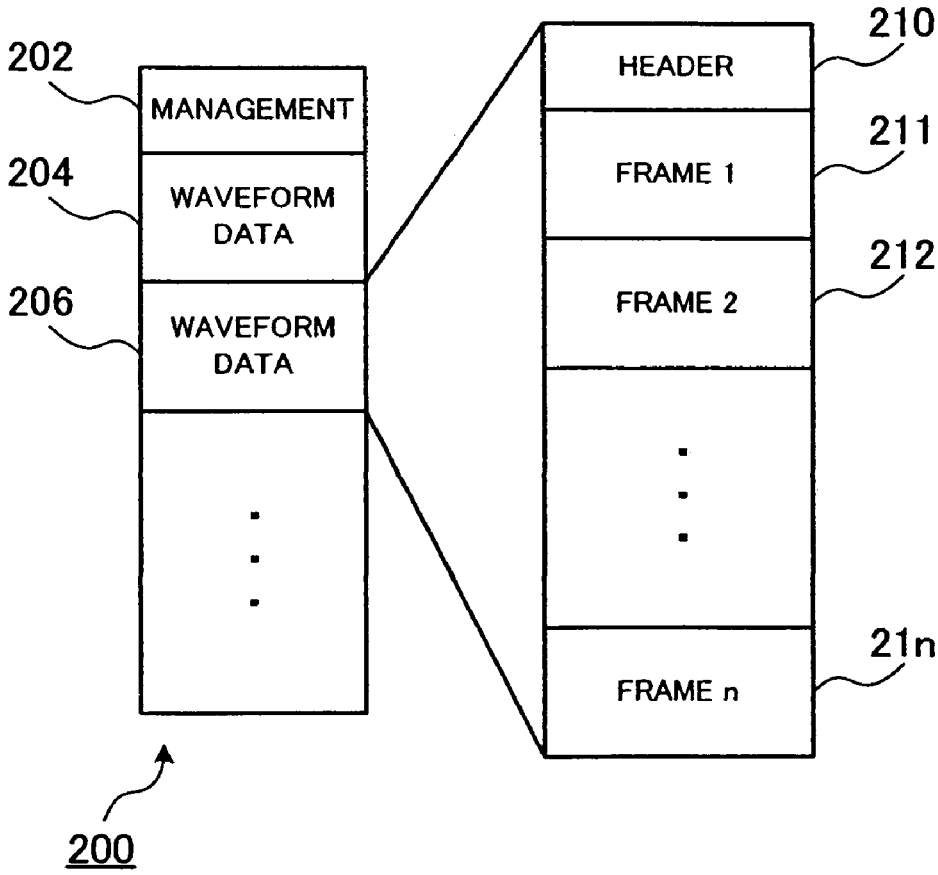
FIG. 11 is a diagram showing still another example of the data structure in accordance with the embodiment embodying the second aspect of the present invention.
FIG. 13 is a diagram showing an example format of a waveform data file handled in the embodiment of FIG. 12.

The inventive frame data structure may be modified as illustratively shown in FIG. 11. Namely, according to the data structure of FIG. 11, the prediction coefficient information in the auxiliary information of the frame represents prediction coefficients of compressed waveform data corresponding to addresses "05"-"09" of the current frame and prediction coefficients of compressed waveform data corresponding to addresses "10"-"14". The number-of-bits information, quantization width information and other information in the auxiliary information of the frame constitutes auxiliary information corresponding to addresses "10"-"19" of a next frame. Where the data structure of FIG. 11 is employed, the decoder 84 operates as follows. Namely, the decoder 84 stores the prediction coefficient information into the buffer memory while the lowest bit of the address is in a range of "0"-"4" and reads out the prediction coefficient information when the lower bit of the address has become "5" so as to use the read-out information as prediction coefficients of compressed waveform data of addresses "05"-"15". More specifically, the prediction coefficient information read out while the lowest bit of the address is in the range of "0"-"4" is stored into a primary buffer memory section, and the prediction coefficient information thus stored is transferred from the primary buffer memory section to a secondary buffer memory section when the lower bit of the address has become "5". The prediction coefficient information thus transferred to the secondary buffer memory section are used as prediction coefficients for compressed waveform data of the following ten addresses, addresses "05"-"15". Further, the decoder 84 stores the number-of-bits information, quantization width information and other information into the buffer memory while the lower bit of the address is in a range of "5"-"9" and reads out these information when the lower bit of the address has become "0" so as to use the read-out information as compression-related information of compressed waveform data of addresses "10"-"19". More specifically, the number-of-bits information, quantization information and other information read out while the lowest bit of the address is in the range of "5"-"9" is stored into another primary buffer memory section, and these information thus stored is transferred from the other primary buffer memory section to another secondary buffer memory section when the lower bit of the address has become "0". These information thus transferred to the other secondary buffer memory section are used as prediction coefficients for compressed waveform data of the following ten addresses, addresses "10"-"19", i.e. as compression-related information of compressed waveform data of the next frame.

Whereas the present invention has been described above in relation to the case where a frame of 160 bits is constructed to have 40 bits allocated to the auxiliary information and 120 bits to the compressed waveform data, the present invention is not so limited. For example, the total number of bits per frame may be other than 160 bits as long as each frame has a fixed length having, as its minimum unit, a data length corresponding to one address, and the allocation ratio between the auxiliary information and the compressed waveform data may also be chosen as desired as long as the respective lengths of the auxiliary information and compressed waveform data are fixed.

Further, although the present invention has been described above in relation to the case where the number of bits per sample of compressed waveform data is a prime number of the number of bits (120 bits in the illustrated example of FIG. 9) in the data area of a large frame, any other suitable number of bits per sample of compressed waveform data may be used. In such a case, the last sample of the compressed waveform data in the frame may be discarded as necessary.

Furthermore, whereas the present invention has been described above as controlling the readout address advancing rate in accordance with the F number corresponding to the pitch of a tone, the readout address may be advanced at a predetermined constant rate. Furthermore, although the F number has been described as comprising integral and decimal fraction portions, it may comprise only an integral portion or decimal fraction portion.

Furthermore, whereas the present invention has been described above in relation to the case where the auxiliary information area of each frame contains compression-related information of a next frame as illustrated in FIG. 9, the number-of-bits information, which is the first auxiliary information in the frame, may be set to indicate a particular number of bits to be used in the decompression process on the compressed waveform data of that frame.

Furthermore, whereas the present invention has been described above as using the LPC (Linear Predictive Coding) scheme for compressing/decompressing waveform data, the invention is also suitable for other schemes than the LPC scheme where compression-related information of 10 to scores of bits is required per frame. For example, the present invention may be applied to various types of adaptive predictive coding (APC) schemes, adaptive transform coding (ATC) schemes, code excited linear prediction (CELP) schemes, etc.

In summary, the above-described embodiment embodying the second aspect of the present invention is characterized in that the number of addresses per frame to be stored in the storage section is fixed and in that a data row stored in each of the addresses is composed of a data area portion of a fixed number of bits storing compressed waveform data and an auxiliary information area portion of a fixed number of bits storing auxiliary information. Because the number of addresses per frame is fixed and the same among the frames, the start positions of successive frames occur at uniform intervals, i.e. every such a number of addresses. Further, the respective numbers of bits in the data area portion and auxiliary information area portion in each of the data rows are fixed, it is possible to readily retrieve the compressed waveform data and auxiliary information from each of the data row. Thus, the construction for reading out and decompressing the compressed waveform data can be simplified to a significant degree. Further, the compression-related information of the auxiliary information in each read-out frame can be used in the decompression process of the compressed waveform data of that frame or next frame.

Furthermore, because the data row is read out from the storage section on the address-by-address basis, the data-area storing region of the frame cache section can be reduced in size. Namely, the data-area storing region need not have a capacity for storing the data areas of a whole frame; it only has to have a capacity for storing one to several data area portions.

Next, a description will be given about an embodiment embodying a third aspect of the present invention.

First, with reference to FIGS. 13 and 14, a description will be given about a data structure for storing, in a waveform memory, waveform data employed in the embodiment embodying the third aspect of the present invention. In FIG. 13, reference numeral 200 represents a waveform data file, in which there are provided waveform data areas 204, 206, . . . for storing various tone waveforms. Reference numeral 202 represents a management area storing management information, such as respective data sizes of these waveform data areas 204, 206, . . . and names of the waveforms. Each of the waveform data areas includes a plurality of frames **211-21*n* and header portion 210**.

In this embodiment embodying the third aspect too, waveform data compressed by the linear predictive scheme are stored in each of the frames. Namely, a predicted value of each sample of interest is calculated in advance by applying a predetermined generating polynomial expression to sampled values of several previous samples, and results obtained by subtracting the predicted values from the actual sampled values are stored, as difference codes, in each of the frames, as will be detailed in FIG. 14. FIG. 14 is similar to FIGS. 9 and 10 but will be explained again for clear understanding of the instant embodiment.

Section (a) of FIG. 14 illustrates a data structure of a frame. Here, each of the frames, which consists of 160 bits, is segmented into ten subframes each consisting of 16 bits. These subframes are each stored in any one of addresses of the waveform memory, and they are imparted with subframe numbers "00"-"09" in correspondence with addresses SFAD within the frame. In each of the subframes, the auxiliary information is stored in first four bits, and the different codes are stored in the remaining 12 bits. In the frame, the auxiliary information of the "00"th subframe includes information indicative of the number of bits bn ("1", "2", "3", "4", "6" or "12") per difference code. In each of the frames, the number of bits bn is the same among the different codes. The auxiliary information of the "01"th to "05"th subframes includes information indicative of prediction coefficients used in the above-mentioned polynomial expression.

Further, the auxiliary information of the "06"th to "07"th subframes includes information indicative of a quantization width, i.e. level width corresponding to the least significant bits of the sampled results. The auxiliary information of the "08"th to "09"th subframes includes various other information. Of these auxiliary information, the number of bits bn, prediction coefficients and quantization width will hereinafter be collectively referred to as "decompression parameters" because they are information to be used for decompression of the difference codes. Here, the auxiliary information included in each of the frames is, in principle, "auxiliary information on the difference codes in a frame to be read out immediately after the current frame".

In the example illustrated in section (a) of FIG. 14, the number of bits bn per difference code is "4", and thus "4" is stored in the auxiliary information of the 00th subframe in a frame to be read out immediately before the current frame. This is because, in the instant embodiment, a necessary number of the subframes in a given frame are read out sequentially to reproduce a tone signal and therefore it is necessary to ultimately fix the individual auxiliary information before readout of the first difference code of the 00th subframe is initiated. For that purpose, the auxiliary information for the first frame is stored in the header portion 210. However, the auxiliary information pertaining to a portion to be reproduced repetitively in a loop (loop portion) is sometimes stored in a fashion different from the above-mentioned principles.

Section (b) of FIG. 14 shows streams of subframes to be decoded. Here, "K_00"th to "K_09"th subframes, constituting a Kth frame are sequentially read out, so that the difference codes included in these subframes are decoded to successively reproduce a tone waveform. The number of bits bn per difference code differs among frames, which is due to the fact that optimal bit widths were chosen for the coding in accordance with degree of variations in the tone waveform and required accuracy. Stated otherwise, in the instant embodiment, each frame is always fixed to the same data length (160 bits) although the number of bits bn per difference code varies variously.

Figure 12:
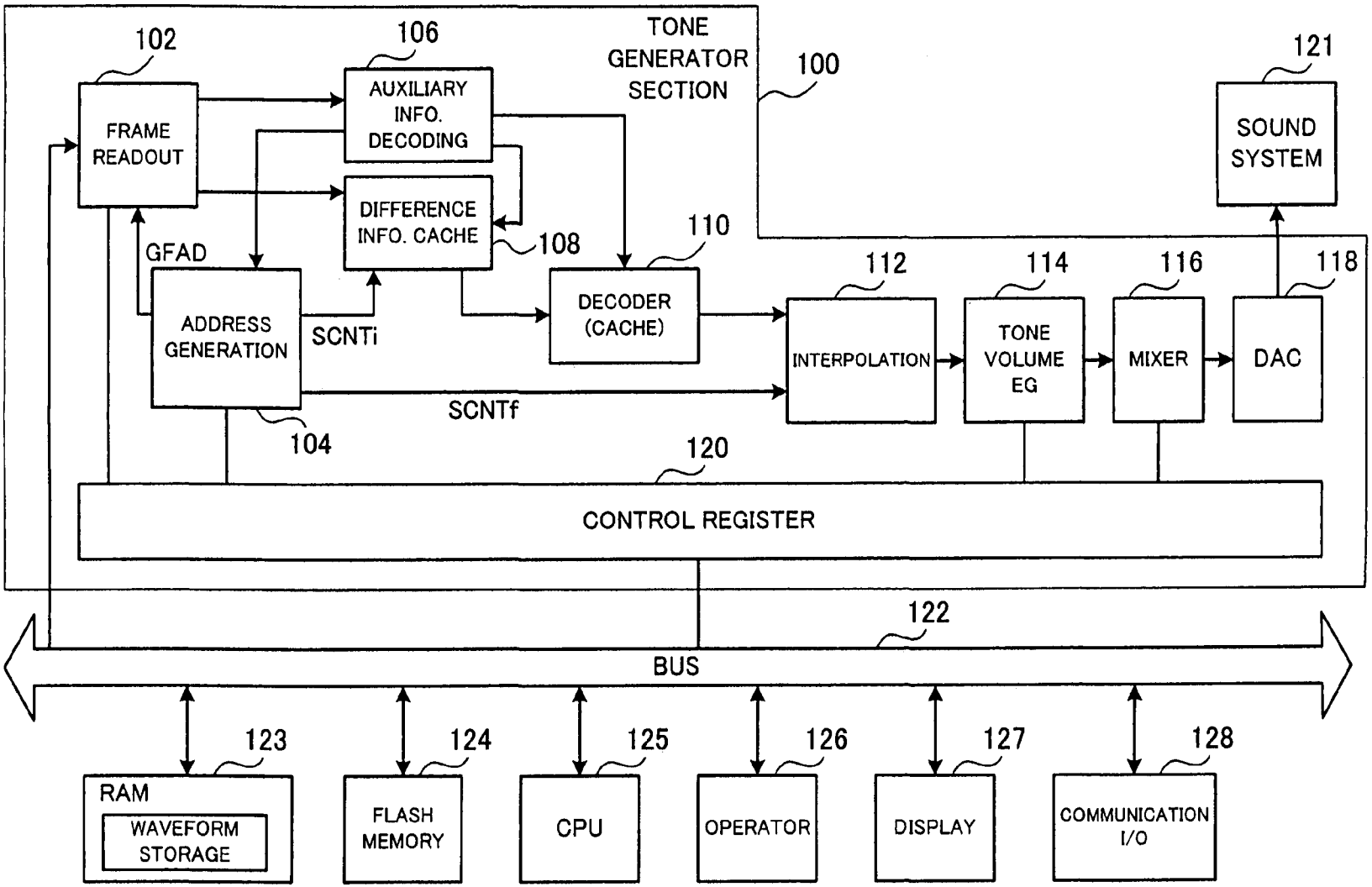
FIG. 12 is a block diagram showing a general hardware setup of an electronic musical instrument in accordance with an embodiment embodying a third aspect of the present invention.

The following paragraphs describe a general hardware setup of an electronic musical instrument in accordance with the embodiment embodying the third aspect, with reference to FIG. 12. The electronic musical instrument comprises a general-purpose personal computer, and an application program running on the personal computer.

In the figure, reference numeral 100 represents a tone generator section that is constructed as a card-type storage medium inserted in the general-purpose personal computer. Reference numeral 123 represents a RAM, in which are stored various data and programs to be used in the personal computer. Particularly, waveform data to be used in the tone generator section 100 are stored in the RAM 123. By thus using part of the RAM 123, originally provided in the personal computer, as a waveform memory, it is possible to reduce a storage capacity that should be possessed by the tone generator section 100 itself.

In a flash memory 124, there are stored an initial program loader etc. CPU 125 controls various components of the electronic musical instrument via a bus 122 on the basis of programs to be later described. Operator unit 126 includes a performing keyboard etc. in addition to operators, such as a keyboard, mouse, etc. originally possessed by the personal computer. Display device 127 visually displays various information to the user. Communication I/O section 128 communicates waveform data etc. with other equipment via a local area network. Sound system 121 audibly reproduces or sounds tone signals supplied from the tone generator section 100.

The tone generator section 100 includes a control register 120, into which various parameters for controlling the tone generator section 100 are written by a CPU 125. Further, in the tone generator section 100, a frame readout section 102 reads out, from a waveform memory region of the RAM 123, subframes including necessary difference codes on a subframe-by-subframe basis. Reference numeral 104 represents an address generation section, which generates synthesized frame addresses GFAD and sample addresses SCNT in accordance with an F number (ratio between pitches of a recorded tone signal and tone signal to be output) written in the control register 120 and a sampling frequency of the frame in question. Here, the "synthesized frame address" GFAD is a signal obtained by synthesizing together a frame address FAD indicative of a frame to be read out and a subframe address SFAD indicative of a subframe to be read out from the frame. The "sample address" SCNT comprises an integral portion SCNTi and decimal fraction portion SCNTf. The integral portion SCNTi indicates a unique number of a difference code in a frame, while the integral portion SCNTi indicates interpolation coefficients for waveform sample values before and after the difference code. Here, the subframe address SFAD increments by one each time the integral portion of the sample address SCNT increases by an amount corresponding to the number of the difference codes stored in each of the subframes.

Further, reference numeral 106 represents an auxiliary information decoder section, which receives the auxiliary information of the subframes read out by the frame readout section 102, accumulates the received auxiliary information over the time period of the frame and thereby decodes the auxiliary information for a next frame. Then, during the time period of the next frame, the auxiliary information decoder section 106 supplies individual associated blocks of the tone generator section 100 with the decoded auxiliary information for decoding etc. of the difference codes of the frame. Reference numeral 108 represents a difference information cache section 108, which receives the difference codes of the subframes read out by the frame readout section 102, stores several latest samples included therein and successively outputs a particular number of the difference codes corresponding to an advance amount represented by the integral portion SCNTi of the sample address. Then, at timing when the difference codes to be output from the difference information cache section 108 run out, a synthesized frame address GFAD indicative of a next subframe is supplied from the address generation section 104 to the frame readout section 102, so that the corresponding subframe is read out and the difference codes included in the read-out subframe are stored in the difference information cache section 108. Reference numeral 110 represents a decoder section, which, each time the difference code is output from the difference information cache section 108, decodes the difference code, using the prediction coefficients and quantization width included in the auxiliary information from the auxiliary information decoder section 106, to thereby determine a sample value of waveform data. The sample values thus determined are sequentially stored in a cache memory provided within the decoder section 110.

Interpolation section 112 performs interpolating arithmetic operation, based on the sample address integral portions SCNTf, on latest two sample values obtained by the decoder section 110. 114 represents a tone volume envelope generation (EG) section, which imparts a predetermined tone volume envelope to the interpolated sample value. The above-mentioned components 102-114 are driven on a time-divisional basis per sampling cycle to synthesize tone signals of a plurality of tone generating channels. Namely, operations are performed for completely different tone generating channels for each of per time-divisional slots obtained by dividing the sampling period by the number of the tone generating channels. Various registers, buffers, etc. are provided for each of the tone generating channels. Mixer 116 mixes tone signals of the plurality of tone generating channels output from the tone volume EG section 114 and outputs the mixed results as stereo tone signals. D/A converter 118 converts the stereo tone signals into analog signals, which are audibly reproduced via the sound system 121.

Figure 15:
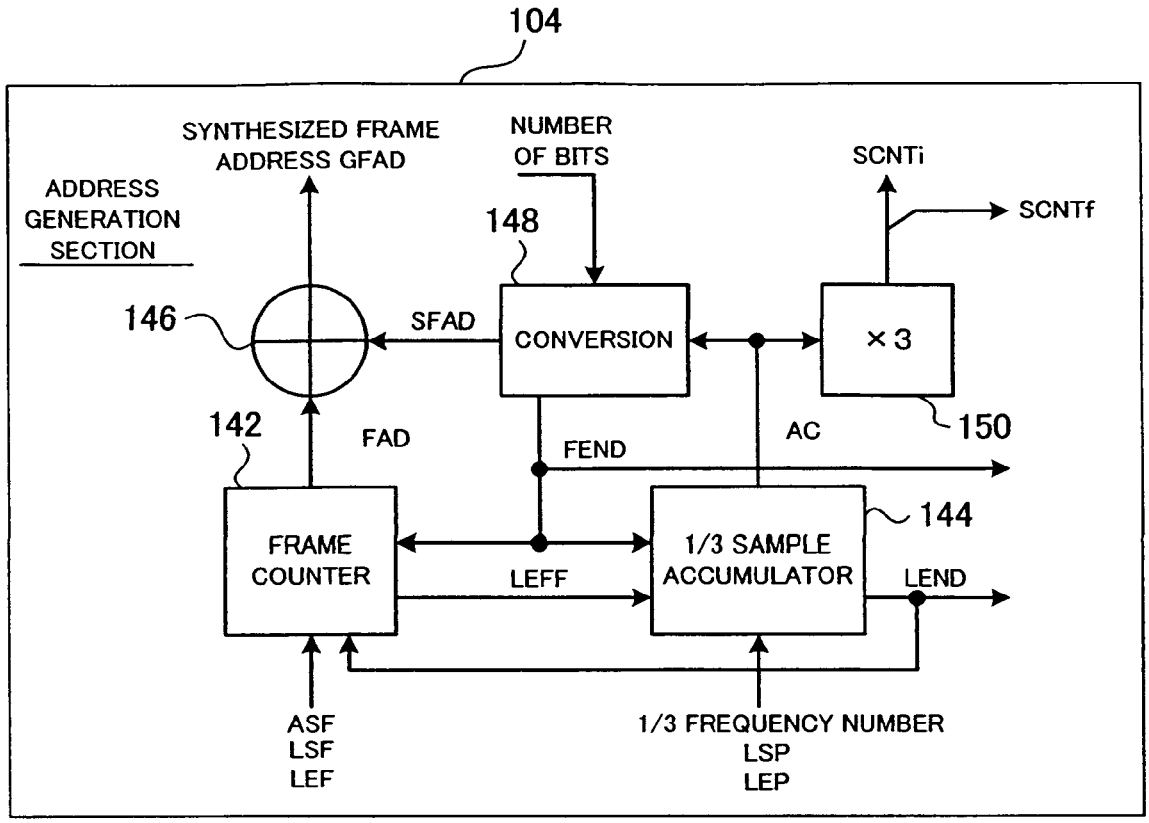
FIG. 15 is a block diagram showing an example setup of an address generation section.

FIG. 15 is a block diagram showing an example setup of the address generation section 104. In FIG. 15, reference numeral 144 represents a ⅓ sample accumulator, which successively accumulates a value of ⅓ (one third) of an F number per sampling cycle. Loop start point LSP and loop end point LEP are supplied via the control register 120 to the ⅓ sample accumulator 144. Multiplier 150 multiplies the accumulated value AC output from the accumulator 144 by a value "3". Namely, the multiplied value output from the multiplier 150 is equal to the value obtained by accumulating the F number per sampling cycle, and it is output as a sample address SCNT.

The address generation section 104 also includes a converter 148, which outputs a subframe address SFAD on the basis of the accumulated value AC output from the accumulator 144 and number of bits per difference code bn (SFAD=AC·bn/4). Normally, the number of bits bn used in the converter 148 is any one of the numbers of bits bn supplied successively from the auxiliary information decoder section 106. Assuming that the number of bits bn is a maximum value "12", the subframe address SFAD is equal to three times the accumulated value AC, i.e. sample address SCNT. Thus, each time the sample address SCNT increments by one, one subframe is read out. Further, assuming that the number of bits bn is "4", the subframe address SFAD is equal to the accumulated value AC, i.e. ⅓ of the sample address SCNT. Thus, each time the sample address SCNT increments by three, one subframe is read out.

The same operations as set forth above are carried out even when the number of bits bn is other than "12" or "4". Namely, the subframe address SFAD increments by one each time the sample address SCNT increments by a value equal to the number of samples of difference codes included in each of the subframes. The following enumerate relationships between various different numbers of bits bn and subframe addresses SFAD.

| Number of Bits bn | Number of Sample Per Frame | SFAD |
|---|---|---|
| 1 bit | 120 | 1/3SCNT × (1/4) |
| 2 bits | 60 | 1/3SCNT × (1/2) |
| 3 bits | 40 | 1/3SCNT × (3/4) |
| 4 bits | 30 | 1/3SCNT × (1) |
| 6 bits | 20 | 1/3SCNT × (3/2) |
| 12 bits | 10 | 1/3SCNT × (3) |

Because the minimum accumulation unit of the accumulator 144 is set to one third of the value of the sample address SCNT, the arithmetic operations for calculating a subframe address SFAD corresponding to the sample address SCNT can be implemented by a combination of multiplication and division using a divisor "¼" or "½". Here, the division using the divisor "¼" or "½" can be implemented by shift operations. Further, because the multiplication can be implemented by an adder and shifter, the converter 148 can be implemented by a shifter, adder, etc. without requiring a divider etc. As a consequence, the construction of the converter 148 can be simplified significantly.

Once the subframe address SFAD produces a carry after having reached "9" indicating the 09-th subframe, a frame end pulse FEND is supplied to the accumulator 144. In response to the supplied frame end pulse FEND, a value corresponding to "the number of difference codes in the current frame/3" is subtracted from the accumulated value in the accumulator 144, after which the accumulator 144 continues the accumulation. Further, once a loop end frame detection signal LEFF, which indicates that the frame address FAD is indicative of a loop end frame LEF, is supplied, the ⅓ sample accumulator 144 operates as follows. Namely, once the accumulated value AC reaches a value corresponding to the loop end point LEP, the ⅓ accumulator 144 outputs a loop end detection signal LEND, and the accumulated value AC is compulsorily reset to a value corresponding to the loop start point LSP.

Further, in FIG. 15, 142 represents a frame counter, which are supplied with an attack start frame ASF, loop start frame LSF and loop end frame LEF stored in the control register 120. Then, the frame counter 142 increments the count (which starts with an attack start frame ASF) by a value equal to the number of addresses in one frame (in this case, "10") each time the frame end pulse FEND is supplied. The counted value of the frame counter 142 is output as a frame address FAD. Then, once the counted value of the frame counter 142 coincides with the loop end frame LEF, the above-mentioned loop end frame detection signal LEFF is output from the frame counter 142 to the ⅓ sample accumulator 144. After that, when a loop end detection signal LEND has been supplied from the ⅓ sample accumulator 144 to the frame counter 142, the frame address FAD is compulsorily reset to the loop start frame LSF in the frame counter 142. Reference numeral 146 represents a synthesis section, which synthesizes together the above-mentioned frame address FAD and subframe address SFAD and outputs the synthesized result as a synthesized frame address GFAD. Sampling cycles used here are not the sampling cycles on the basis of which the individual blocks of the tone generator section 100 operate, but those defining recorded order of individual samples of waveform data stored in the waveform memory.

Figure 16:
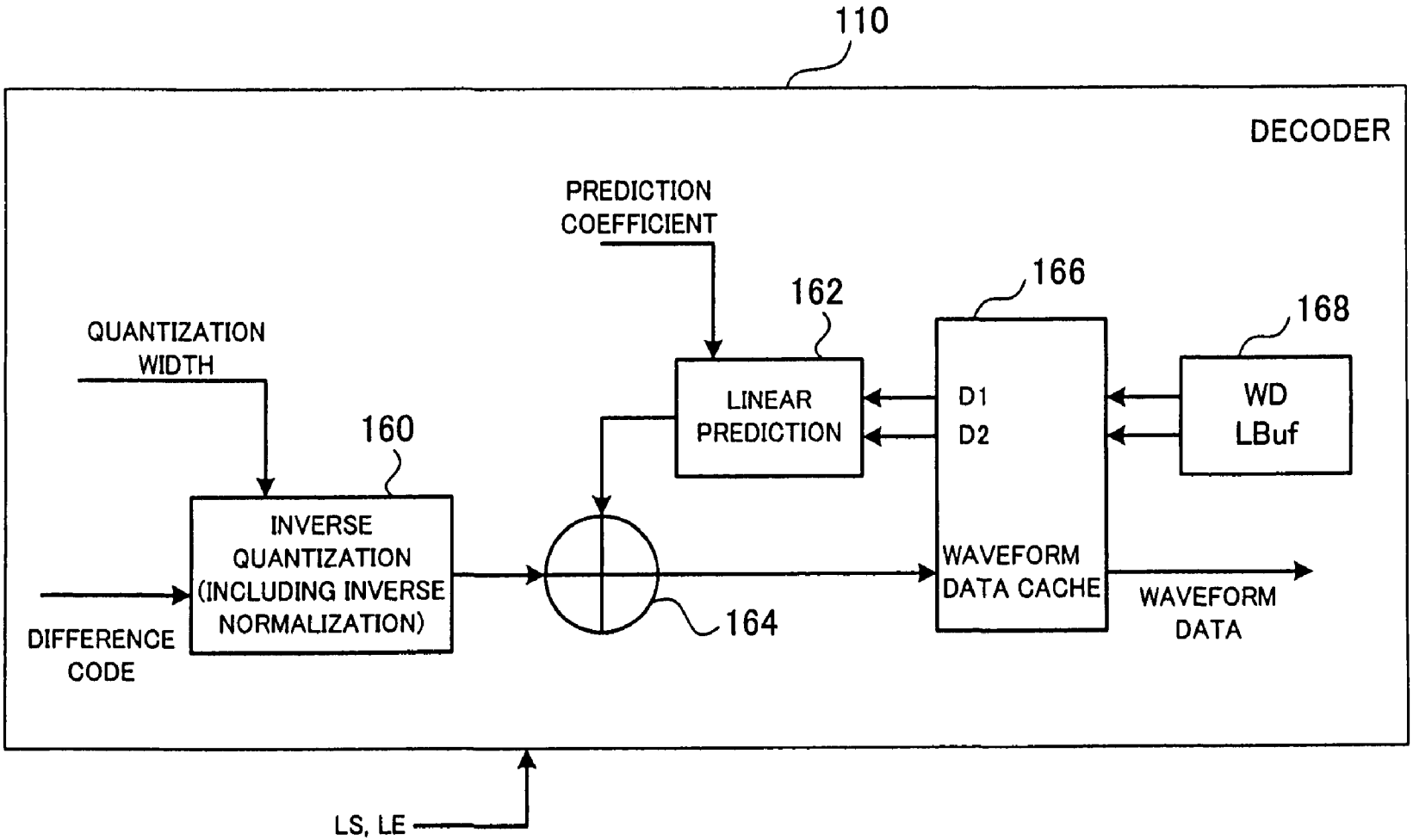
FIG. 16 is a block diagram showing an example setup of a difference information cache section.

This and following paragraphs describe details of the construction of the decoder section 110, with reference to FIG. 16. In the figure, an inverse quantization section 160 outputs a value indicative of a difference between a predicted value and an actual value on the basis of a difference code and quantization width. Linear prediction section 162 calculates a predicted value of the sample at the latest sampling cycle by applying a predetermined generating polynomial expression to sample values D1 and D2 and prediction coefficients at previous two sampling cycles. Adder 164 adds together the predicted value and difference value to calculate a sample value at the latest sampling cycle.

Reference numeral 168 represents a loop-start sample value buffer, which stores therein last two sample values in a frame immediately preceding a loop start frame address LS. 166 represents a waveform data cache memory, which stores the calculated sample values over a plurality of cycles and supplies sample values D1 and D2 at previous two sampling cycles to the above-mentioned linear prediction section 162.

However, if the current sampling cycle coincides with the loop start point LSP, two sample values stored in the loop-start sample value buffer 168 are passed as the values D1 and D2 to the linear prediction section 162. If the current sampling cycle is a sampling cycle immediately following the loop start point LSP, the sample value at the loop start point LSP and the last sample value stored in the sample value buffer 168 are supplied to the linear prediction section 162 as the values D1 and D2, respectively. This is for the purpose of allowing results of repeated loop-portion reproduction to be the same between when a shift has occurred from the attack portion to the loop portion and when the loop portion is being reproduced repetitively.

In the above-described embodiment, the difference codes are sequentially retrieved from the difference information cache section 108 and decoded in accordance with the sample address SCNT incrementing at a rate corresponding to a pitch of a tone. If no difference code corresponding to the sample address SCNT is stored in the difference information cache section 108, then an address GFAD of a subframe including the difference code is supplied from the address generation section 104 to the frame readout section 102, and the difference information cache section 108 is replenished with the difference codes of the subframe read out in accordance with the address GFAD. The auxiliary information included in the read-out subframe is also supplied to the auxiliary information decoder section 106 and reproduced frame by frame.

The auxiliary information of each frame is necessary to decode the difference codes; however, the instant embodiment, where the auxiliary information is reproduced from each subframe read out for difference codes, can eliminate a need for separately accessing the RAM 123 to read out the auxiliary information. Therefore, the instant embodiment can significantly simplify the construction of the circuit for supplying auxiliary information necessary for decompression of difference codes. Further, although the instant embodiment is constructed to access the waveform memory using the bus 122 shared among the waveform memory and other devices, such as the CPU 125, such access has little adverse influences on the behavior of the other devices, because frequency of the channel-by-channel access to the waveform memory is substantially constant and does not vary so much.

Next, a description will be given about general operation of the decompression process.

First, uncompressed waveform data are supplied via the communication I/O section 128 to the RAM 123. When loop reproduction is performed on the waveform data, a provisional loop portion is set by the user. Namely, desired two sampling points are designated as a provisional loop start point and provisional loop end point. If the provisional loop start and end points do not satisfy predetermined loop conditions, the waveform data are modified so that the predetermined loop conditions are met. Here, the "loop conditions" are that several samples before and after the provisional loop start point and several samples before and after the provisional loop end point coincide with each other in level and time directions. If the predetermined loop conditions are satisfied, when the portion of the waveform between the provisional loop start and end points is read out and reproduced, no unpleasant noise will be produced because the provisional loop end portion can smoothly connect to the provisional loop start point. Then, the waveform data are segmented into a plurality of sections corresponding to a plurality of frames. At that time, a real-time frame size (i.e., 120/number of bits bn) is determined on the basis of accuracy required for reproduction of waveform data and complexity of waveform level variations.

Figure 19:
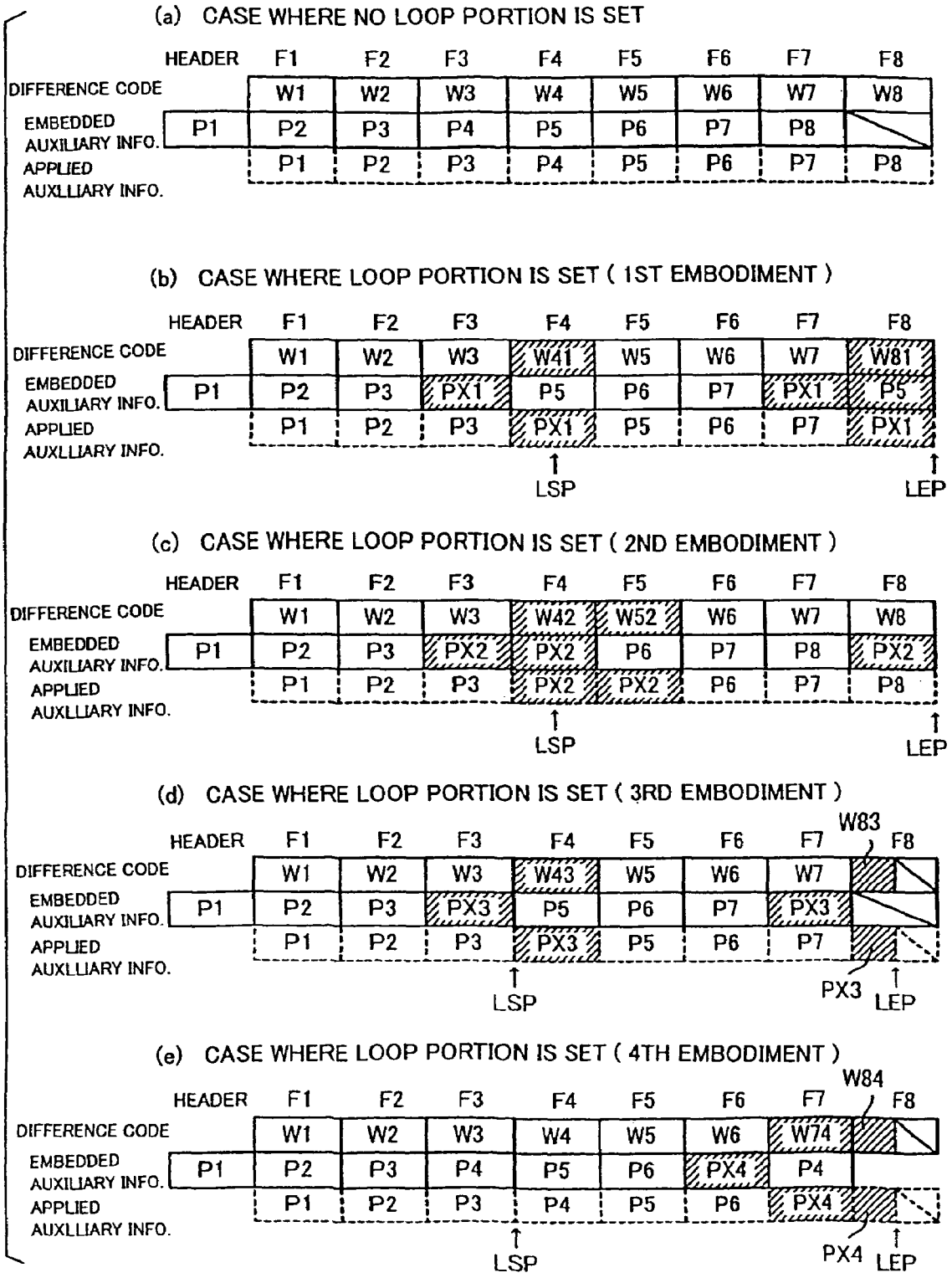
FIG. 19 is a diagram explanatory of an operation for determining decompression parameters.

In segmenting the waveform data into the frames, the number of samples per frame (which is determined in accordance with the number of bits to be used for frame compression) is set to be the same among four frame sections: three frame sections including one frame section which the provisional frame start point belongs to; and another frame section which the provisional loop end point belongs to, in order to allow shared use of decompression parameters between two frames shown in section (b) or (c) of FIG. 19 (as will be later described). Note that, although it is only necessary that the number of samples be the same between at least two frame sections, the instant embodiment is arranged to set the number of samples to be the same among all of the above-mentioned four frame sections, in order to achieve simplification of processing. Further, if the number of samples is set to be the same among all the frame sections from the one which the loop start point belongs to the one which the loop end point belongs to, the processing can be simplified even further.

Figure 17:
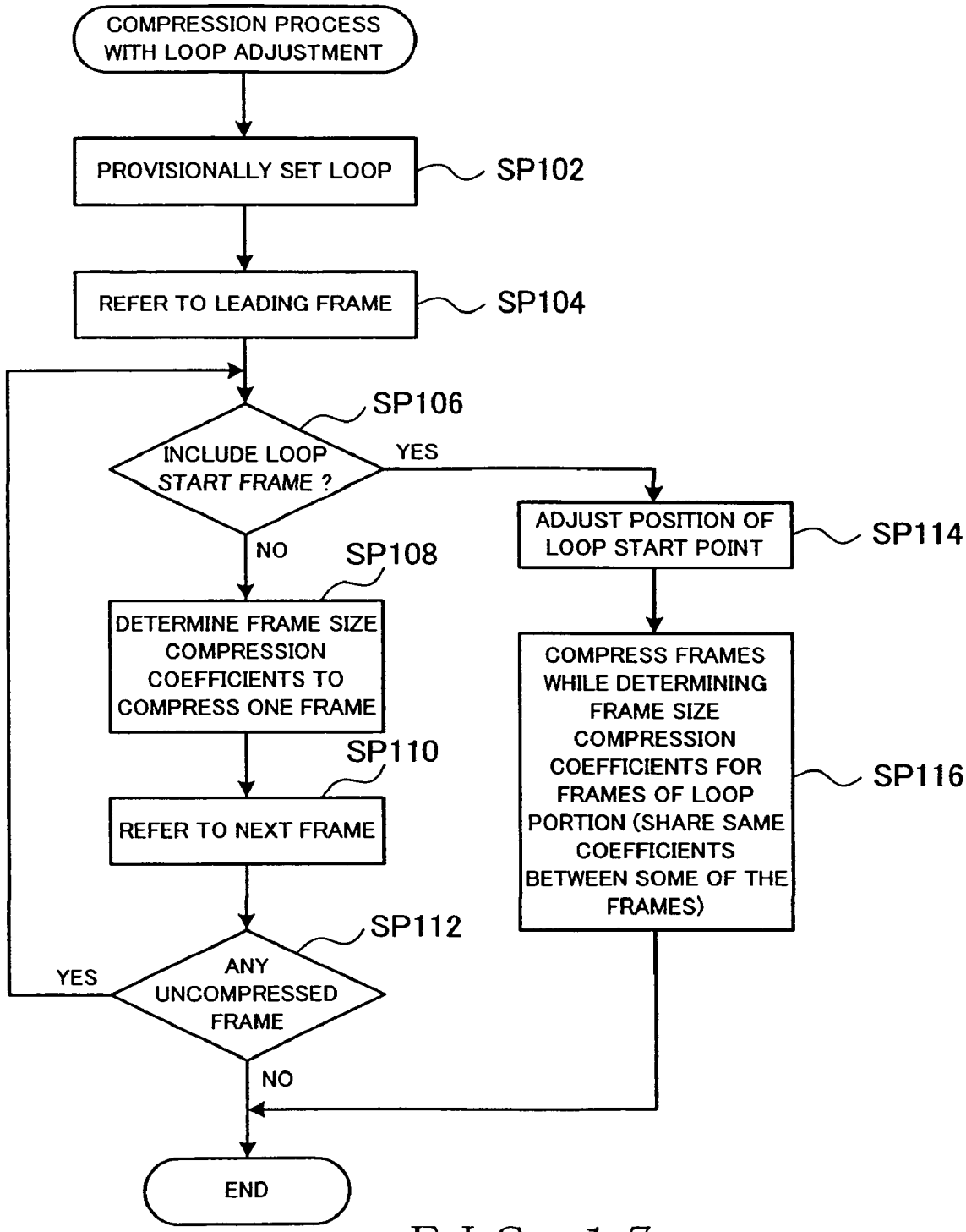
FIG. 17 is a flow chart of a compression process routine.

Then, in response to predetermined operation performed by the user, a compression process routine of FIG. 17 is started up. Once the compression routine goes to step SP102, the provisional loop start point and provisional loop end point designated by the user are set as variables LSP1 and LEP1, respectively. Of the waveform data, a portion from the leading or first sampling point to a point immediately preceding the provisional loop start point LSP1 will hereinafter be referred to as "A portion", a portion from the provisional loop start point LSP1 to the provisional loop end point LEP1 will hereinafter be referred to as "B portion", and a portion following the provisional loop end point LEP1 will hereinafter be referred to as "C portion". Then, at next step SP104, reference is made to contents of the leading frame section of the waveform data. At following step SP106, a determination is made as to whether or not the frame section being currently referred to includes the provisional loop start point LSP1.

If a "NO" determination is made at step SP106, the routine proceeds to step SP108, where trial prediction coefficient calculating arithmetic operations and waveform compression arithmetic operations, based on the auto-correlation, are repetitively performed on the waveform data of the frame section being referred to. In this way, decompression parameters, such as the number of bits bn, prediction coefficients and quantization width, and other auxiliary information are determined, so that compression operations are performed on the waveform data of the frame section in question, using the decompression parameters. Namely, difference codes of the frame corresponding to the frame section and auxiliary information of a preceding frame are formed and stored in the RAM 123. Then, once the routine goes to step SP100, reference is made to a next frame section following the frame section having been compressed. At next step SP112, a determination is made as to whether there is any frame section yet to be subjected to the compression operations. If answered in the affirmative at step SP112, the routine reverts to step SP106. After that, the operations of steps SP106-SP112 are repeated until the frame section including the provisional loop start point LSP1 is referred to. In this way, the waveform data of each frame section being referred to are sequentially compressed so that the difference codes and auxiliary information are sequentially stored into the RAM 123. In case no loop portion is provisionally set from the beginning, the operations of steps 106-SP112 are repeated, and the instant compression process routine is brought to an end after all of the frames have been subjected to the compression process.

Once the routine goes to step SP106 after the frame including the provisional loop start point LSP1 has been referred to at step SP110, an "YES" determination is made, so that the routine proceeds to step SP114. At step SP114, results of adjusting the positions of the provisional loop start/end points LSP1 and LEP1 are set as loop start/end points LSP and LEP. As a consequence, the loop start frame LSF including the loop start point LSP may sometimes become a frame following the frame that originally included the provisional loop start points LSP1. Details of the operation at step SP114 will be described later. At next step SP116, for each of the frames including the adjusted loop portion, a real-time frame size (number of bits bn), prediction coefficient, quantization width and other auxiliary information are determined, and the compression process is performed on these frames. Details of the operation at step SP116 will also be described later. After that, the routine is brought to an end.

The following paragraphs describe the adjustment of the loop start/end points LSP and LEP (step 114 above).

Figure 18:
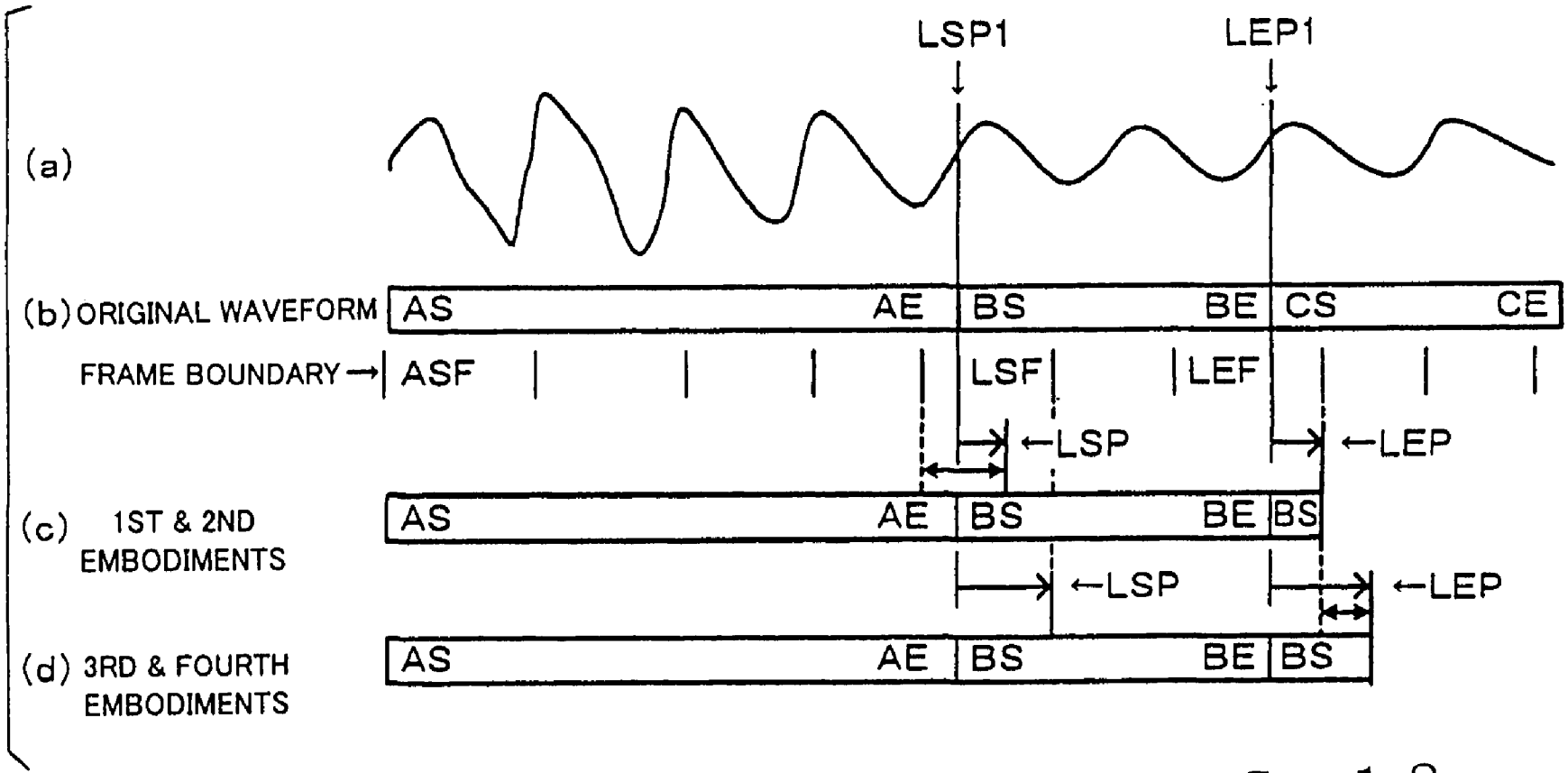
FIG. 18 is a diagram explanatory of an operation for setting loop start/end points.

FIG. 18 is a diagram explanatory of details of the adjustment performed at step SP114 on the loop start/end points LSP and LEP. Specifically, section (a) of FIG. 18 is a waveform diagram of recorded waveform data, and section (b) of FIG. 18 shows boundaries (divided points) between the frames. In section (b) of FIG. 18, the vertical lines represent the boundaries between the frames. In the figure, LSP1 and LEP1 represent provisional loop start and end points set at step SP102 above. Section (c) of FIG. 18 shows positions of the loop start/end points LSP and LEP having been adjusted at step SP114.

First, the adjusted loop end point LEP is set at the last sampling point of the frame which the provisional loop end point LEP1 belongs to (i.e., loop end frame LEF). Then, the adjusted loop start point LSP is set at a sampling point located behind and spaced apart from the provisional loop start point LSP1 by a distance equal to the number of samples as the number of samples from the provisional loop end point LEP1 to the loop end point LEP. Then, individual samples from the provisional loop start point LSP1 to the loop start point LSP are copied to a portion from the provisional loop end point LEP1 to the loop end point LEP. Note that the waveform data following the loop end point LEP are unnecessary and therefore discarded.

Let's now consider output signals produced when waveform data are reproduced on the basis of the provisional loop start/end points LSP1 and LEP1. From section (b) of FIG. 18, it can be seen that waveform data of the A portion are first reproduced only once and then waveform data of the B portion are reproduced repetitively. Let's also consider output signals produced when waveform data are reproduced on the basis of the loop start/end points LSP and LEP. From section (c) of FIG. 18, it can be seen that waveform data of a portion up to immediately before the loop start point LSP (i.e., the whole of the A portion plus leading area of the B portion) are first reproduced only once and then a portion between the loop start/end points LSP and LEP (i.e., areas of the B portion other than the leading area thereof plus the leading area of the B portion) are reproduced repetitively Namely, in both of the cases, there occurs no difference in the waveform data reproduced.

Namely, according to the instant embodiment, it is possible to generate tone signals with no noise due to the loop readout just as in the case where no shift of the loop start and end points, irrespective of the arrangement that the positions of the loop start and end points LSP and LEP are set by shifting the provisional loop start/end points LSP1 and LEP1 so as to cause the loop end point LEP to coincide with the frame boundary. Thus, the instant embodiment can eliminate a need for time-axial compression/expansion etc. of the waveform data, and can cause the loop end point LEP to coincide with the frame boundary while permitting high-quality tone reproduction.

This and following paragraphs describe details of the operation at step SP116 for determining decompression parameters for individual frames, with reference to FIG. 19. Section (a) of FIG. 19 illustrates a construction of the frames in a case where waveform data are formed as a total of eight frames (frames F1-F8) and there is set no loop portion.

In the figure, each of the frames F1-F8 includes difference codes W1-W8. Assume here that decompression parameters P1-P8 are applied to decoding of these difference codes W1-W8. The decompression parameters P1 to be applied to the first frame F1 are stored in the header portion 210, and, in each of the frames F1-F7, there are stored the decompression parameters P2-P8 to be applied to the difference codes W2-W8 for another frame to be reproduced following the frame in question.

Section (b) of FIG. 19 is explanatory of operations performed when a loop portion is set for the waveform data. In the illustrated example, the loop start point LSP is set at an enroute (intermediate) point of the frame F4, and the loop end point LEP is set at the last sampling point of the frame F8. Common or same decompression parameters PX1 are applied to the frames F4 and F8. Thus, difference codes W41 and W81 coded in accordance with the decompression parameters PX1 are stored in the frames F4 and F8. Further, the decompression parameters PX1 are stored in the frames F3 and F7 to be reproduced immediately before the frames F4 and F8.

Then, in the frame F8, there are stored the decompression parameters P5 to be applied to the frame F5 to be reproduced two frames after the frame F8 (i.e., to be reproduced following the frame F4). This is because the decompression parameters P5 included in the frame F4 undesirably can not be restored completely since the frame F4 starts to be read out partway (at the loop start point LSP).

The common decompression parameters PX1 are applied to the frames F4 and F8 as stated above, and the decompression parameters PX1 are determined in the following manner. As illustrated in section (a) of FIG. 20, the decompression parameters PX1 may be determined by assuming waveform data connected at frames F8 and F4 and repeating trial prediction coefficient calculating arithmetic operations and waveform compression arithmetic operations on the waveform data on the basis of the auto-correlation or covariance method.

Figure 20:
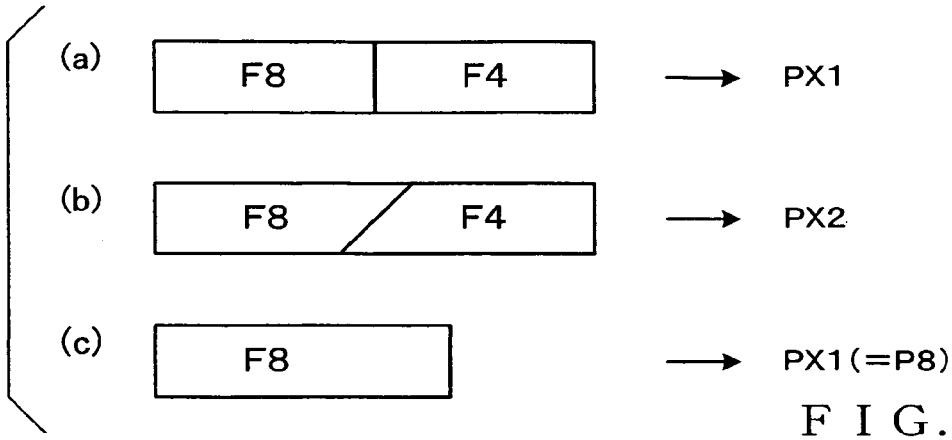
FIG. 20 is a diagram explanatory of an operation for determining decompression parameters to be shared between different frames.

Also, as illustrated in section (b) of FIG. 20, the decompression parameters PX1 may be determined on the basis of waveform data obtained by cross-fading the waveform data of the two frames. Further, because the frames F4 and F8 are frames interconnected during loop reproduction, it is very likely that the waveform data of the two frames F4 and F8 have similar characteristics. Therefore, in many cases, no inconvenience would be encountered even when the decompression parameters PX1 are determined on the basis of the waveform data of only one of the frames F4 and F8. In such a case, either one of the decompression parameters P4 and P8, which is not used in loop reproduction (parameter P8 in the illustrated example), may be used as the decompression parameters PX1 as illustrated in section (c) of FIG. 20.

Next, a reproduction process performed in the instant embodiment will be described. Once a note-on event is generated as an automatic performance based on music piece data of an SMF (Standard MIDI File) is executed or MIDI signals are input via the communication I/O section 128, the note-on event is assigned to any one of the plurality of tone generating channels possessed by the tone generator section 100. Then, under control of the CPU 125, various tone generating parameters, corresponding to a tone color selected in a performance part indicated by the event and tone pitch indicated by the event, are written into an area of the control register 120 corresponding to the assigned tone generating channel.

The parameters to be written into the control register 120 also include a ⅓ frequency number, attack start frame ASF, loop start/end frames LSF and LEF, loop start/end points LSP and LEP, various tone volume EG parameters, etc. Further, by the CPU 6 instructing the tone generating channel to start generating a tone, the tone generator section 100 is caused to initiate the reproduction process for the tone generating channel. In the reproduction process, waveform data are read out from the RAM 123 on a subframe-by-subframe basis, individual difference codes included in each of the subframes are decoded, and the decoded waveform data are imparted with a tone volume envelope. The thus-generated tone signal of the tone generating channel is mixed with tone signals with other tone generating channels and converted into analog representation.

In the subframe-by-subframe readout, sample addresses SCNT, incrementing at a rate corresponding to the tone pitch indicated by the event, are generated by the accumulators 144 and 150, and difference codes corresponding to the sample addresses SCNT are retrieved from among those already read into the difference information cache section 108 and supplied to the decoder section 110. In case the difference codes corresponding to the sample addresses SCNT have not been read into the difference information cache section 108, a synthesized frame address GFAD for reading out a next subframe is generated by the frame counter 142, accumulator 144, adder 146 and converter 148. The subframe indicated by the synthesized frame address GFAD is read out from the RAM 123 by the frame readout section 102, so that the difference cores of the read-out subframe are supplied to the difference information cache section 108 and the auxiliary information of the subframe is supplied to the auxiliary information decoder section 106.

The following paragraphs describe details of the reproduction process.

Let it be assumed here that the number of bits bn per sample of the loop start/end frames LSF and LEF is "4" (the number of difference codes are "30"), the loop end point LEP is the last sampling point of the loop end frame LEF and the loop start point LSP is the "15"th sampling point of the loop start frame LSP. In the instant embodiment, it is essential that the same decompression parameters be shared between the loop end frame LEF and the loop start frame LSF. Also assume that, at a sampling cycle immediately following a sampling cycle where the reproduction is completed up to the "28th" difference code of the loop end frame, the ⅓ sample accumulator 144 accumulates one third of the F number and the sample address integral portion SCNTi increments by four.

In the instant example, the ⅓ sample accumulator 144 outputs a loop end detection signal LEND, and the frame address FAD of the frame counter 142 is set to indicate the loop start frame LSF. Assuming that the loop start point LSP coincides with the 15th sample, a next reproducing point (i.e., four samples after the 28th difference code of the loop end frame) coincides with a 16th sampling point of the loop start frame LSF. In the instant embodiment, where the linear prediction scheme is employed, the sample value of every reproducing point can not be obtained unless all the difference codes belonging to the individual reproducing points are decoded sequentially. Therefore, it is necessary to obtain all difference codes up to the next reproducing point (i.e., difference codes belonging to a hatched region in the figure).

Figure 22:
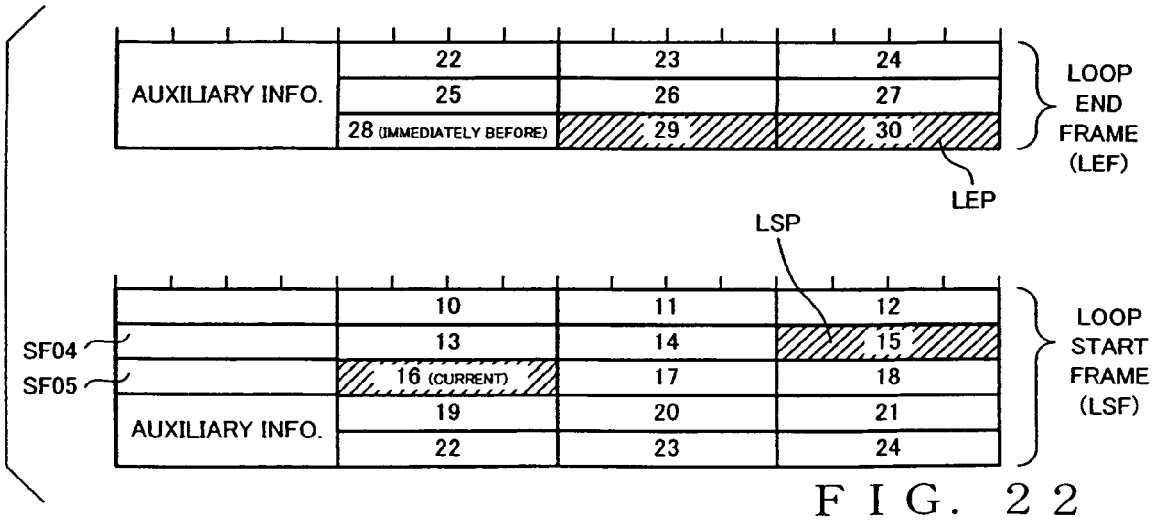
FIG. 22 is another diagram explanatory of operations during the loop reproduction.

Further, in the instant embodiment, the difference codes are read out in subframes, i.e. on the subframe-by-subframe basis. Thus, in the illustrated example of FIG. 22, where reproduction has been completed up to the 28th difference code of the loop end frame LEF, the 29th and 30th difference codes indicated by hatching should already have been loaded in the difference information cache section 108. Then, in order to obtain the 15th and 16th samples of the loop start frame LSF, two subframes SF04 and SF05 are read out from the RAM 2.

Namely, at the sampling cycle in question, the 29th and 30th difference codes of the loop end frame already loaded in the difference information cache section 108 are sequentially supplied to the decoder section 106. Then, when the subframe SF04 has been read out, the difference codes included in the subframe SF04 are loaded into the difference information cache section 108, of which the 15th difference code in the loop start frame is supplied to the decoder section 106. Further, when the subframe SF05 has been read out, the difference codes included in the subframe SF05 are loaded into the difference information cache section 108, of which the 16th difference code in the loop start frame is supplied to the decoder section 106. In this case, although the difference information cache section 108 is operable as long as it has a storage capacity of at least one subframe per tone generating channel, constructing the cache section 108 to have a storage capacity of several subframes per tone generating channel can facilitate timing design of the frame readout section 102, difference information cache section 108, etc. In any case, the difference information cache section 108 need not have a great storage capacity, such as 10 subframes equal to one frame.

Figure 21:
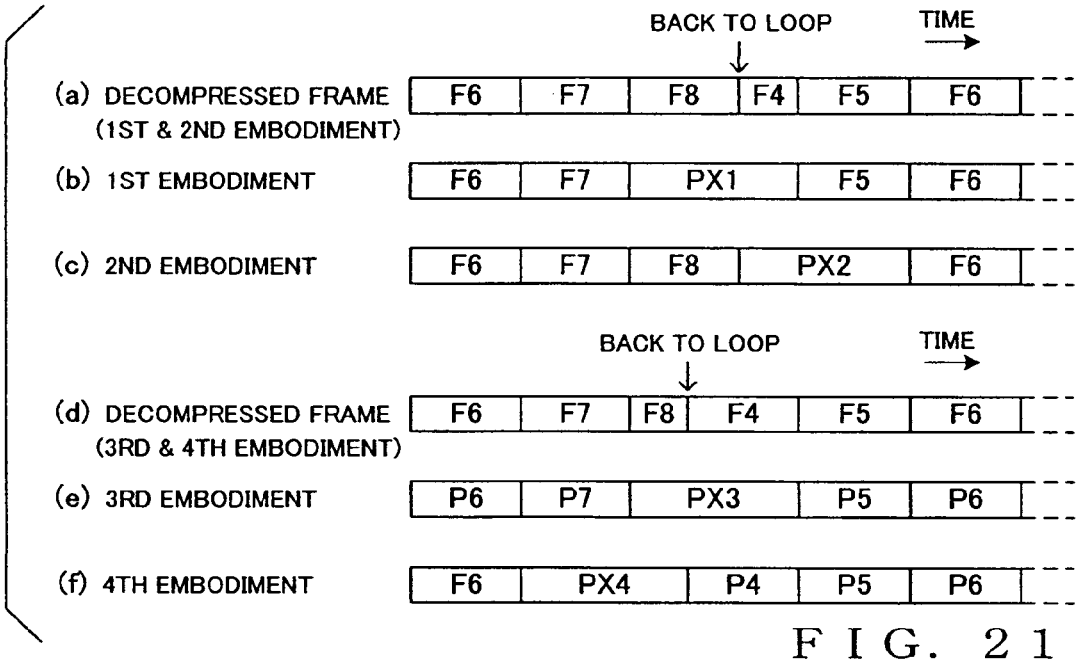
FIG. 21 is a diagram explanatory of operations during loop reproduction.

In sections (a) and (b) of FIG. 21, there are shown relationship between frames to be reproduced during loop reproduction and auxiliary information. As shown, for decompression of the difference codes of frames F6, F7 and F8, there are employed decompression parameters P6, P7 and PX1 that are stored in frames immediately preceding the frames F6, F7 and F8. Although the loop start frame F4 is read out following the loop end frame F8, the same decompression parameters PX1 as having been applied to the loop end frame F8 are applied to the decompression of the difference codes of the loop start frame F4, as set forth above. For the next frame F5 onward, there are employed the decompression parameters P5, P6, . . . that are stored in the frames immediately preceding the frames F5, F6, . . . .

As set forth above, the instant embodiment can make the loop end point LEP conform to the frame boundary without having to perform time-axial compression/expansion or the like that would undesirably deteriorate the quality of the waveform data. Further, with the arrangements that the common decompression parameters PX1 are applied to the loop start/end frames LSF and LEF and stored in the frame immediately preceding the loop end frame LEF and that the decompression parameters P5 to be applied to the frame immediately following the loop start frame LSF are included in both of the loop start/end frames LSF and LEF, the decompression parameters PX1, having been applied to the loop end frame LEF, can be applied continuously to reproduction of the loop start frame LSF including the loop start point LSP at an enroute point thereof, so that all the frames can be reproduced appropriately in a looped or repeated fashion. Further, with the arrangements that the auxiliary information including the decompression parameters etc. is located dispersedly within the frames and the difference codes in the currently read-out are decompressed on the basis of the decompression parameters included in a previously-read-out frame, the instant embodiment can obtain the auxiliary information of the individual frames as it sequentially reads out the subframes to obtain the difference codes; thus, the instant embodiment can eliminate a need for making separate or dedicated access to the RAM to read out the auxiliary information.

This and following paragraphs describe a modification of the embodiment embodying the third aspect of the present invention, which are generally similar in substance to the above-described embodiments but different therefrom as regards the way in which the decompression parameters are determined (step SP116) and the way in which the decompression parameters are applied to the loop reproduction. Decompression parameter determination process in the modified embodiment is explained with reference to section (c) of FIG. 19. In the illustrated example, the loop start point LSP is set at an enroute point of the frame F4 and the loop end point LEP is set at the last sampling point of the frame F8, as in the example of section (b) of FIG. 19. Same decompression parameters PX2 are applied to the loop start frame LSF and frames F4 and F5 immediately following the loop start frame LSF. Therefore, difference codes W42 and W52 decoded in accordance with the decompression parameters PX2 will be stored in the frames F4 and F5, respectively.

Further, the decompression parameters PX2 are stored in the frames F3 and F8 to be reproduced immediately before the frame F4. The decompression parameters PX2 are determined in generally the same manner as the above-described decompression parameters PX1; the decompression parameters PX2 are determined on the basis of waveform data obtained by connecting together the waveform data of either one or both of the frames F4 and F8.

When the waveform data reproduction shifts from the attack portion to the loop portion, the difference codes W42 of the frame F4 are decompressed on the basis of the decompression parameters PX2 included in the frame F3, and then the difference codes W52 of the frame F5 are decompressed on the basis of the decompression parameters PX2 included in the frame F4. Further, when the waveform data reproduction has shifted from the loop end point LEP back to the loop start point LSP, the decompression parameters PX2 included in the loop end frame F8 are applied to decompression of the difference codes W42 of the frame F4 and then to decompression of the difference codes W52 of the immediately-following frame F5 (see sections (a) and (b) of FIG. 21).

This and following paragraphs describe another modification of the embodiment embodying the third aspect of the present invention, which are generally similar in substance to the above-described embodiments but different therefrom as regards the way in which the uncompressed waveform data are segmented into frame sections, the way in which the loop start/end points LSP and LEP are determined (step SP114), the way in which the decompression parameters are determined (step SP116) and the way in which the decompression parameters are applied to the loop reproduction.

First, operations for segmenting the uncompressed waveform data into frame sections are described. In the instant modified embodiment, three frame sections: the frame section following the frame section which the provisional loop start point belongs to; the frame section which the provisional loop end point belongs to; and the frame section which the provisional loop end point belongs to, are set to have the same number of samples (namely, the same real-time frame size). This is because same decompression parameters are applied to any two of the three frame sections (as will be later described) and therefore a same real-time frame size has to be set in accordance with the "number of bits bn" included in the auxiliary information. To permit the application of the same decompression parameters to the two frames, it is only necessary for at least the two frame section to have the same frame size; however, in the instant embodiment, every one of the above-mentioned three frame sections is set to have the same frame size or same number of samples. Further, if all of the frames, from the one immediately following the frame to which the loop start point belongs to the frame to which the loop end point belongs, are set to the same number of samples, the frame setting operations can be even further simplified.

Next, operations performed at step SP114 for determining the loop start/end points LSP and LEP are explained with reference to FIG. 18. As stated earlier, sections (a) and (b) of FIG. 18 show recorded waveform data and frame boundaries (dividing points). Section (d) of FIG. 18 shows loop start/end points LSP and LEP having been adjusted at step SP114 in the embodiment.

In section (d) of FIG. 18, the frame immediately following the frame to which the provisional loop start point LSP1 belongs is set as the loop start frame LSF, and the leading or first sampling point of the loop start frame LSF is set as the loop start point LSP. Then, the loop end point LEP is set at a sampling point located behind and spaced from the provisional loop end point LEP1 by a distance corresponding to the number of samples from the provisional loop start point LSP1 to the loop start point LSP. As a consequence, the frame immediately following the frame to which the provisional loop end point LEP1 originally belonged may sometimes become the loop end frame LEF. Then, individual sample values from the provisional loop start point LSP1 to the loop start point LSP are copied to a portion from the provisional loop end point LEP1 to the loop end point LEP. In the instant modified embodiment too, waveform data following the loop end point LEP are unnecessary and therefore discarded.

Namely, according to the instant modified embodiment, the provisional loop start/end points LSP1 and LEP1 are shifted so that the loop start point LSP coincides with the frame boundary and thereby positions of the loop start/end points LSP and LEP are set. Then, similarly to the first and second embodiments described above, there can be generated exactly the same tone signals as in the case where no such shift is made. Thus, the instant embodiment too can eliminate the need for time-axial compression/expansion etc. of the waveform data, and can make the loop end point LEP coincide with the frame boundary while permitting high-quality tone reproduction.

Next, the operation performed at step SP116 for determining decompression parameters for individual frames is explained with reference to section (d) of FIG. 19. In the illustrated example, the loop start point LSP is set at the beginning of the frame F4, and the loop end point LEP is set at an enroute point of the frame F8. Further, same decompression parameters PX3 are applied to the frames F4 and F8 set as the loop start/end frames LSF and LEF.

Thus, in the frames F4 and F8, there are stored difference codes W43 and W83 coded in accordance with the decompression parameters PX3. Further, the decompression parameters PX3 are stored in the frames F3 and F7 to be reproduced immediately before the frames F4 and F8. The decompression parameters PX3 are determined in generally the same manner as the decompression parameters PX1; the decompression parameters PX3 are determined on the basis of waveform data obtained by connecting together the waveform data of either one or both of the frames F4 and F8.

When the waveform data reproduction shifts from the attack portion to the loop portion, the difference codes W43 of the frame F4 are decompressed on the basis of the decompression parameters PX3 included in the frame F3, then the difference codes of the individual frames in the loop portion are decompressed, and then the difference codes W83 of the frame F8 set as the loop end frame LEF are decompressed on the basis of the decompression parameters PX3 included in the decompression parameters included in the frame F7. Further, when the waveform data reproduction has shifted from the loop end point LEP back to the loop start point LSP, the decompression parameters PX3 having been applied to the loop end frame F8 are also applied to decompression of the difference codes W43 of the frame F4 set as the loop end frame LEF (see sections (d) and (e) of FIG. 21).

This and following paragraphs describe still another modification of the embodiment embodying the third aspect of the present invention, which are generally similar in substance to the above-described third embodiment but different therefrom as regards the way in which the decompression parameters are determined (step SP116) and the way in which the decompression parameters are applied during the loop reproduction. The operation for determining the decompression parameters are explained with reference to section (e) of FIG. 19. As in the illustrated example of section (d) of FIG. 19, the loop start point LSP is set at the beginning of the frame F4, and the loop end point LEP is set at an enroute point of the frame F8. Further, same decompression parameters PX4 are applied to the loop end frame LEF and frames F7 and F8 following the loop end frame LEF.

Thus, in the frames F7 and F8, there are stored difference codes W74 and W84 coded in accordance with the decompression parameters PX4. Further, the decompression parameters PX4 are stored in the frame F6 to be reproduced immediately before the frame F7. The decompression parameters PX4 are determined in generally the same manner as the decompression parameters PX1-PX3; the decompression parameters PX4 are determined on the basis of waveform data obtained by connecting together the waveform data of either one or both of the frames F7 and F8. Further, in the frame F7, there are stored the decompression parameters PX4 to be applied to the frame F4 set as the loop start frame LSF.

Once the reproduced position reached the frame F6 during reproduction of the waveform data, the decompression parameters PX4 are read out along with the difference codes W6. Then, the difference codes W74 of the next frame F7 are decompressed on the basis of the thus read-out decompression parameters PX4, and the difference codes W84 of the loop end frame F8 following the frame F7 are decompressed. Namely, the decompression parameters PX4 read out simultaneously with the difference codes W74 of the frame F7 are not applied to the difference codes W84 of the loop end frame F8, but applied to decompression of the difference codes W4 of the frame F4 set as the loop start frame LSF following the frame F8 (see sections (d) and (f) of FIG. 21).

It should be appreciated that the present invention is not limited to the above-described embodiments and may be modified variously, for example, in manners as stated below.

(1) Whereas the above-described embodiments use the waveform data format as shown in FIGS. 13 and 14, the waveform data format to be used in the present invention may be modified variously as necessary. For example, various data may be placed at positions different from those in the above-described embodiments. The data size per subframe may be other than "16" bits, such as "8" or "32" bits. Further, the data size per frame may be other than "10" words (="160" bits), such as "6" or "14" words. Furthermore, the number of bits per difference code may be other than "1", "2", "3", "4", "6" or "12", such as "8" or "16".

(2) Whereas the above-described embodiments each employ the second-order linear prediction scheme, the present invention may employ higher-order linear prediction or a plurality of stages of linear prediction. Alternatively, the present invention may employ other compression schemes completely different from the linear prediction scheme, such as a formant synthesis scheme. Moreover, whereas the decompression parameters stored in each of the frames in the above-described embodiments comprise the number of bits bn, prediction coefficients and quantization width, it is needless to say that the necessary decompression parameters differ depending on the compression scheme employed.

(3) Whereas the above-described embodiments are each constructed to implement an electronic musical instrument by an application program running on a personal computer, the application program alone may be stored in a storage medium, such as a CD-ROM or flexible disk, for distribution; alternatively, the application program alone may be distributed via a communication network. Of course, operations to be performed by the individual components in the tone generator section 100 may be carried out by software using the application program.

In summary, with the above-described inventive arrangement that loop start and loop end points are set on the basis of designated provisional loop start and loop end points, at least one of the loop start and loop end points can be made to coincide with a frame boundary, so that the number of frames that can not be fully reproduced can be minimized to only one. As a result, the present invention can eliminate the need for time-axial compression/expansion etc. of waveform data, and permits high-quality tone reproduction.

Further, with the inventive arrangement that same decompression parameters are applied to two given portions or sections, reading out the decompression parameters only once for the two portions can suffice.

Furthermore, with the arrangement that a tone signal is reproduced on the basis of the difference codes in a single read-out frame and decompression parameters in a previously-read-out frame, the present invention can promptly initiate the reproduction of the tone signal since the necessary decompression parameters have already been obtained by the time when the single frame is about to be reproduced.

What is claimed is:

1. A waveform storage processing apparatus comprising:

a storage section having a storage area specified with a plurality of addresses each having a data width of n bits;

a segmentation section that segments input waveform data into a plurality of frames;

a compression section that, for each of the frames, performs a compression process on the waveform data to thereby generate compressed waveform data of m divided by bits;

an auxiliary information generation section that, for each of the frames, generates auxiliary information including compression information indicative of a form of the compression process performed on the frame;

a to-be-written data formation section that, for each of the frames, forms a predetermined number j of to-be-written data of n bits on the basis of data of m bits formed by retrieving samples of the compressed waveform data, k samples at a time, and data of n−m bits from of the auxiliary information of a next frame; and a writing section that sequentially writes the j to-be-written data, formed for each of the frames, to the storage area specified with the predetermined number j of successive addresses of said storage section.

2. A waveform storage processing apparatus as claimed in claim 1 wherein the n−m bits data of the n bit data of one frame stored at the j successive addresses in said storage section comprises an auxiliary information area of the next frame for storing the auxiliary information and the m bit data of the n bit of one frame stored at the j successive addresses in said storage section comprises a data area of the frame for storing the compressed waveform data.

3. A waveform storage processing apparatus as claimed in claim 1 wherein the bit-number m divided by k of the compressed waveform is variable between the frames and a particular number i*k of samples of the waveform data, corresponding to the bit-number m divided by k for one frame, are segmented into the frame by said segmentation section.

* * * * *